US011678733B2

(12) United States Patent
Maddox

(10) Patent No.: US 11,678,733 B2
(45) Date of Patent: Jun. 20, 2023

(54) COSMETIC CONTAINER DEVICE

(71) Applicant: RHEYA INCORPORATED, Los Angeles, CA (US)

(72) Inventor: Aidan Maddox, Redmond, WA (US)

(73) Assignee: RHEYA INCORPORATED, Los Angeles, CA (US)

( * ) Notice: Subject to any disclaimer, the term of this patent is extended or adjusted under 35 U.S.C. 154(b) by 252 days.

(21) Appl. No.: 16/737,772

(22) Filed: Jan. 8, 2020

(65) Prior Publication Data

US 2021/0204675 A1 Jul. 8, 2021

(51) Int. Cl.

*A45D 34/04* (2006.01)
*A45D 40/26* (2006.01)
*A45D 34/00* (2006.01)

(52) U.S. Cl.

CPC ..... *A45D 40/267* (2013.01); *A45D 34/046* (2013.01); *A45D 2034/005* (2013.01)

(58) Field of Classification Search

CPC .... A45D 34/04; A45D 34/042; A45D 34/043; A45D 34/045; A45D 34/046; A45D 40/26; A45D 40/262; A45D 40/264; A45D 40/265; A45D 40/267; A45D 2034/005; A45D 2034/002

USPC ..... 401/121, 122, 126–130

See application file for complete search history.

(56) References Cited

U.S. PATENT DOCUMENTS 3,341,884 A * 9/1967 Pryor ..... A45D 34/042 401/160
6,464,418 B1 * 10/2002 Visser ..... A45D 40/24 206/509
7,565,714 B2 * 7/2009 Gueret ..... A46B 9/10 15/160
2012/0020720 A1 * 1/2012 L'Abbate ..... A45D 40/265 401/129
2014/0205358 A1 * 7/2014 Pschirer ..... A45D 40/26 401/126

OTHER PUBLICATIONS

Zao Makeup: "Aloe vera mascara"; acquired from the Internet: URL: https://zaomakeup.com/en/aloe-vera-mascara; downloaded on Jan. 27, 2022.

Mob Beauty: "Mascara Capsule"; acquired from the Internet: URL: https://mobbeauty.com/products/mascara-capsule ; downloaded on Jan. 27, 2022.

(Continued)

*Primary Examiner* — David J Walczak
(74) *Attorney, Agent, or Firm* — Tucker Ellis LLP

(57) ABSTRACT

A cosmetic container device includes an exterior body and an inner capsule for storing a cosmetic product. The inner capsule may be received in the exterior body. An outer cap removably coupled to a first end of the exterior body may include an application device for removing and applying the cosmetic product stored within the inner capsule. The cosmetic container device may further include an end cap removably coupled to a second end of the exterior body. The cosmetic container device may further include one or more fixation devices for removably securing the inner capsule to the end cap. Removal of the end cap from the exterior body may allow the inner capsule to be removed from the exterior body, so that the cosmetic container device can be refilled by replacing the inner capsule.

20 Claims, 32 Drawing Sheets

(56) References Cited

OTHER PUBLICATIONS

Trestique: "Good Vibes Mascara"; acquired from the Internet: URL: https://www.trestique.com/products/cruelty-free-makeup-good-vibes-mascara; downloaded on Jan. 27, 2022.

* cited by examiner

COSMETIC CONTAINER DEVICE

FIELD OF INVENTION

Embodiments of the present invention relate generally to containers for storing cosmetics, and particularly to a refillable cosmetics container device.

BACKGROUND

Cosmetic storage containers may be used to store various cosmetic products and preparations, such as mascara, lip gloss, concealer, toner, and other types of makeup. The containers are commonly manufactured for one-time use, such that the entire container is discarded after the cosmetic preparation stored therein has been used up, or the user no longer wishes to use it.

SUMMARY OF INVENTION

Embodiments of the present invention relate generally to containers for storing cosmetics, and particularly to a refillable cosmetics container device. A cosmetic container device according to an embodiment includes an exterior body and an inner capsule for storing a cosmetic product. The inner capsule may be received in the exterior body. An outer cap removably coupled to a first end of the exterior body may include an application device for removing and applying the cosmetic product stored within the inner capsule. The cosmetic container device may further include an end cap removably coupled to a second end of the exterior body. The cosmetic container device may further include one or more fixation devices for removably securing the inner capsule to the end cap. Removal of the end cap from the exterior body may allow the inner capsule to be removed from the exterior body, so that the cosmetic container device can be refilled by replacing the inner capsule.

In an embodiment, a cosmetic container device for storing a cosmetic product includes an exterior body having a first end, a second end, and a throughpassage extending from an opening in the first end to an opening in the second end of the exterior body; an outer cap removably coupled to the first end of the exterior body; an inner capsule disposed in the exterior body for storing the cosmetic product, the inner capsule having an opening in a first end and a second closed end, wherein a cavity within the inner capsule is accessible through the opening at the first end; and an end cap removably coupled to the second end of the exterior body, wherein the inner capsule is configured to be removed from the exterior body through the opening at the second end of the exterior body when the end cap is detached from the exterior body.

The cosmetic container device can further include an elongated member coupled to the outer cap and extending into the cavity within the inner capsule.

An application device can be attached to the elongated member, the application device configured to remove at least a portion of the cosmetic product from the inner capsule.

The application device can be removably coupled to the elongated member.

The first end of the inner capsule can be removably coupled to the outer cap.

The cosmetic container device can further include a wiper having an opening, the wiper configured to be at least partially installed in the cavity of the inner capsule.

The inner capsule can be configured to be replaced with another inner capsule storing another cosmetic product.

The inner capsule can be removably coupled to the end cap.

The inner capsule can be removably coupled to the end cap using one or more fixation devices.

At least a portion of the one or more fixation devices can include a ferrous material adapted to removably couple the inner capsule to the end cap.

The cosmetic container device can further include further comprising at least one magnet for removably coupling the inner capsule to the end cap.

The inner capsule can further include a securing mechanism to secure the inner capsule within the exterior body.

In an embodiment, a cosmetic container includes: a body having a polygonal shape and including a first end having an opening, a second end, and a hollow space extending between the first end and the second end, for receiving an inner capsule; an outer cap removably coupled to the first end of the body; and an end cap removably coupled to the second end of the body and including one or more fixation devices for securing the end cap to the inner capsule.

The cosmetic container can further include a shoulder at the first end of the body extending in a direction perpendicular to the body and configured to abut an outer surface of the inner capsule, to prevent the inner capsule from being removed through the opening in the first end.

The cosmetic container can further include an elongated member coupled to the outer cap and adapted to extend into the inner capsule while the outer cap is coupled to the first end of the body and the inner capsule is within the hollow space.

The end cap can further include one or more notches to secure the end cap to the body.

In an embodiment, an inner capsule for a cosmetic container includes: a main body portion having a first end and a second end, the main body portion having a first diameter and defining a cavity, and one or more notches; a top end portion extending from the first end of the main body portion and defining an open end, and having a second diameter less than the first diameter; and a bottom end portion extending from the second end of the main body portion and defining a closed end, the bottom end portion having a third diameter less than the first diameter.

The one or more notches can be adapted to secure the inner capsule within the cosmetic container.

The inner capsule can further include a fixation device secured to the bottom end portion.

The inner capsule can further include an indentation in a bottom surface of the bottom end portion, for receiving the fixation device.

Other features and advantages of embodiments of the present invention will become apparent from the following detailed description, taken in conjunction with the accompanying drawings which illustrate, by way of example, features of the present invention.

DETAILED DESCRIPTION

Embodiments of the present invention relate to a cosmetic container device having an exterior body and an inner capsule. The device may store a cosmetic product such as mascara, lip gloss, concealer, toner, or any other makeup or cosmetic product or preparation. The inner capsule may store the cosmetic product and may be replaced, refilled, reused, or removed as desired.

In the following detailed description, certain example embodiments are shown and described, by way of illustration. As those skilled in the art would recognize, the described example embodiments may be modified in various ways without departing from the spirit and scope of the present invention. Accordingly, the drawings and description are to be regarded as illustrative in nature, rather than restrictive.

Figure 1:
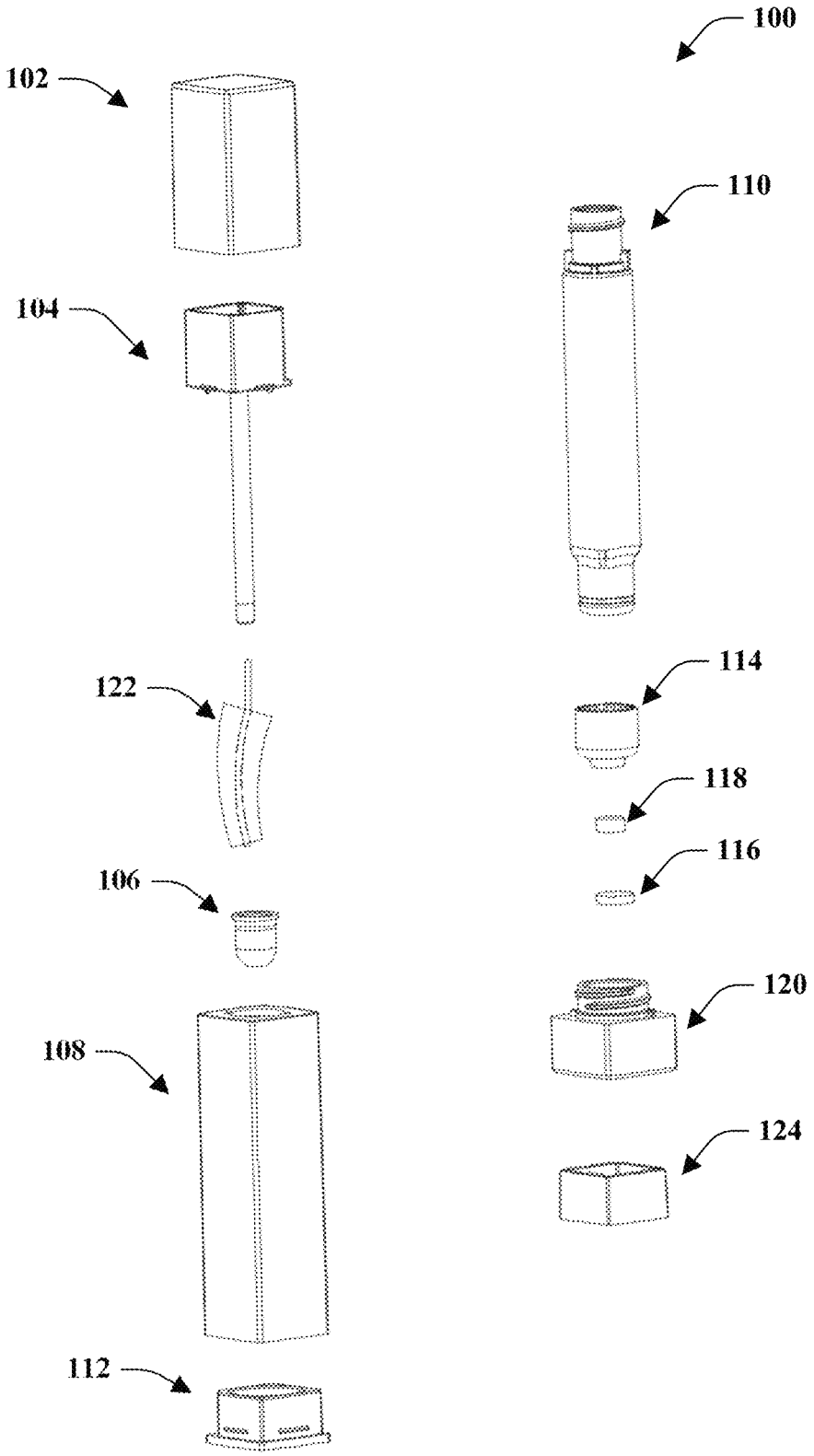
FIG. 1 is an exploded view of an example embodiment of a cosmetic container device.

Turning to FIG. 1, a cosmetic container device 100 according to an embodiment includes a wand portion and a storage portion removably connected to the wand portion. The wand portion includes an outer cap 102 and an inner cap 104 coupled to the outer cap 102. The storage portion includes an exterior body 108, a collar 112 attached to the exterior body 108, an end cap 120 removably connected to the collar, and an inner capsule 110 substantially disposed within the exterior body 108 and removably coupled to the end cap 120 via one or more fixation devices 114, 116, and 118. A wiper 106 may be included between the inner cap 104 and the inner capsule 110, and the wiper 106 may be configured to be at least partially installed in a cavity of the inner capsule 110. An inner base 124 may be at least partially installed in the end cap 120. Exterior elements of the cosmetic container device 100 may include the outer cap 102, the exterior body 108, and the end cap 120. Interior elements may include the inner cap 104, the wiper 106, the inner capsule 110, the collar 112, the inner base 124, and the fixation devices 114, 116, 118.

The exterior body 108 may have a first end, a second end, and a throughpassage defining a hollow space, extending from an opening in the first end to an opening in the second end. The inner capsule 110 may store a cosmetic product and may be removably installed in the cosmetic container device 100. The outer cap 102 and the end cap 120 may be removably attached to the exterior body 108 to seal the cosmetic container device 100 and to hold the inner capsule 110 within the exterior body 108. The wiper 106 may be placed between the inner capsule 110 and the inner cap 104 to create a seal. To access the cosmetic product, the outer cap 102 may be removed from the exterior body 108. Removing the outer cap 102 may provide access to the contents (i.e., cosmetic product) of the inner capsule 110. According to an embodiment, the cosmetic container device 100 can be refilled by replacing the inner capsule 110 with another inner capsule storing another cosmetic product.

The inner cap 104 may be coupled, either fixedly or removably, to the outer cap 102. Further, the inner cap 104 may include an application device 122, such as a brush, for applying the cosmetic product from the inner capsule 110 to a user's face, skin, or hair. The application device 122 may extend into and reach the contents of the inner capsule, and may be configured to remove at least a portion of the cosmetic product stored therein from the inner capsule 110. A distal end of the application device 122 may have a shape or be otherwise configured such that the contents of the inner capsule 110 can adhere to the application device 122, to allow the contents to be removed from the inner capsule 110 along with the application device 122.

The application device 122 may be fixedly or removably installed within the inner cap 104. Removable installation within the inner cap 104 may allow the application device 122 to be replaced with a new or different device as desired. For example, mascara may be stored in the inner capsule 110 and may be applied using a mascara brush. There may be numerous shapes, sizes, and configurations for mascara brushes. Removable installation of a mascara brush may allow a user to switch between various mascara brushes to obtain a desired result.

Figure 2:
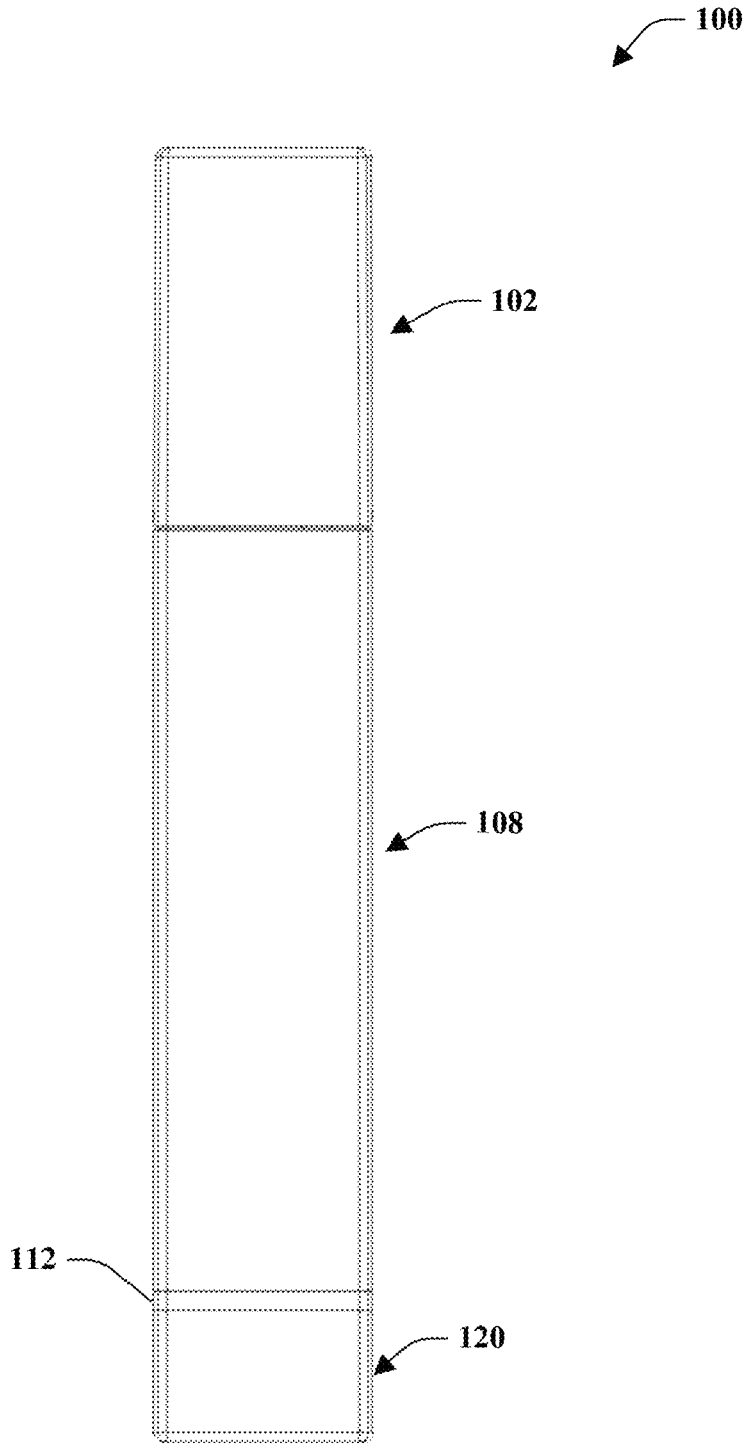
FIG. 2 is an exterior view of an example embodiment of a cosmetic container device in a closed configuration.

The collar 112 and the end cap 120 may be coupled to a second end of the exterior body 108 opposite the first end. The collar 112 may be coupled, either fixedly or removably, to the exterior body 108. In an embodiment, the end cap 120 may include external threading to mate with internal threading of the collar 112, the threading allowing the end cap 120 to be removably attached to the collar 112 and the exterior body 108. In another embodiment, the end cap 120 may include an inner base 124 coupled, either fixedly or removably, to the end cap 120. The collar 112 may include a throughpassage to allow the inner capsule 110 to pass through the collar for removing of the inner capsule 110 from the exterior body 108. In an example embodiment, at least a portion of the collar 112 may be located between the exterior body 108 and the end cap 120, as shown in FIG. 2. In another example embodiment, the collar 112 may be attached to and completely internal to the exterior body 108. In another example embodiment, the collar 112 may be integral with the exterior body 108 instead of a separate piece.

Turning to FIG. 2, external elements of a cosmetic container device 100 according to an embodiment are shown; namely, the outer cap 102, the exterior body 108, and the end cap 120. The outer cap 102, the exterior body 108, and the end cap 120 may be shaped in any suitable manner. For example, one or more of the external elements may have a square shape as shown in FIGS. 1 and 2. The external elements may also be round or any polygonal shape, as desired. It should be appreciated that the external elements may be the same or a similar or otherwise corresponding shape, or may be shaped differently from one another.

Figure 3:
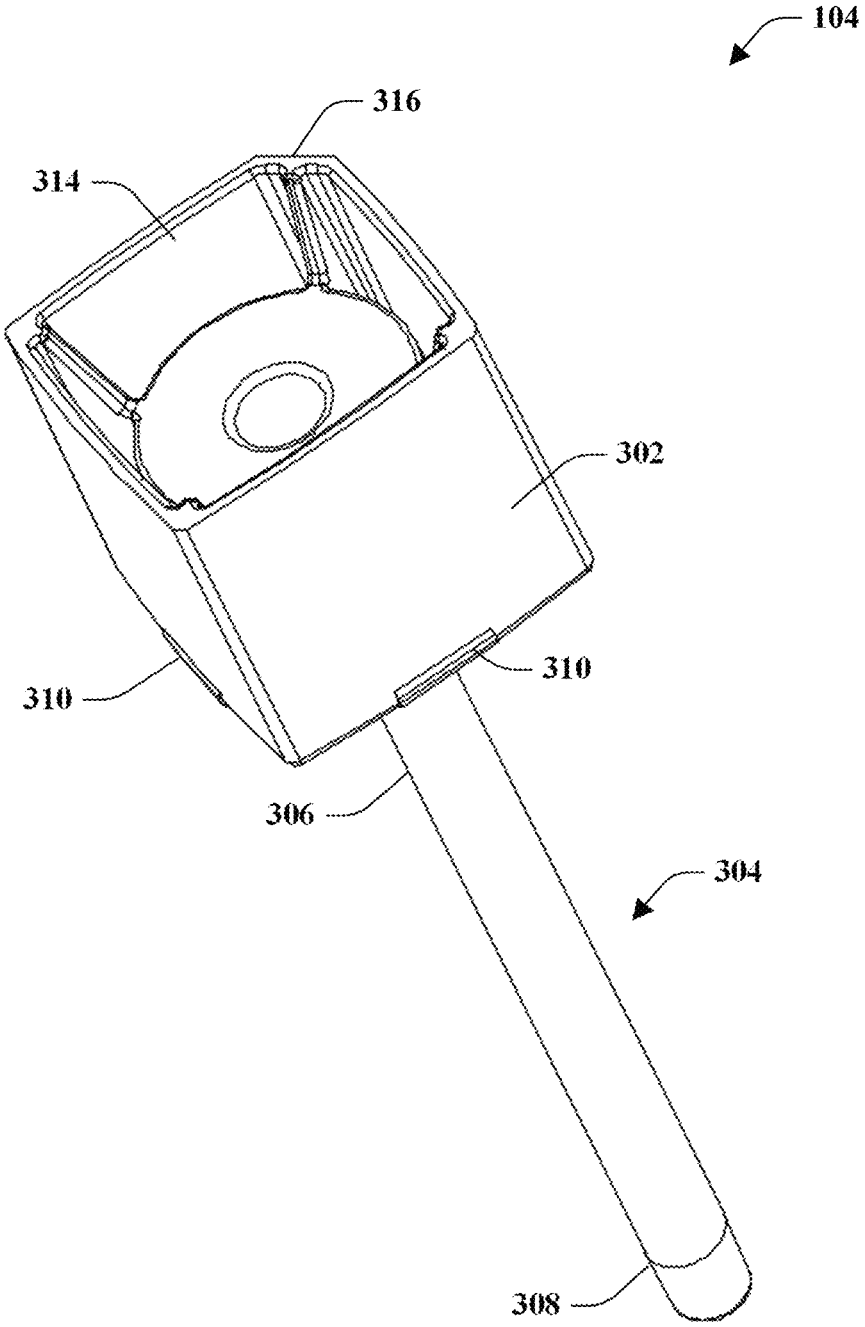
FIG. 3 is an example embodiment of an inner cap of a cosmetic container device.

Turning to FIG. 3, an embodiment of the inner cap 104 is shown. The inner cap 104 may include a cap collar 302 and an elongated member 304. The cap collar 302 may be conformably or similarly shaped to the outer cap 102 to allow the inner cap 104 to be inserted into the outer cap 102. The cap collar 302 may include an internal structure 314 and attachment members 310. The attachment members 310 may be fixed to the external surface of the cap collar 302 and may latch to a respective member on the inside surface of the outer cap 102 to secure the inner cap 302 to the outer cap 102. The cap collar 302 may also include a notch 316 that may engage with a location of the outer cap 102 to ensure that the inner cap 104 is secured to the outer cap 102 in a correct orientation.

In an example embodiment, the cap collar 302 may be attached to the internal surface of the outer cap 102 without attachment members 310. The cap collar 302 may be attached to the internal surface of the outer cap 102 by adhesive, pressure fit, snap fit, or any combination thereof (e.g., attachment members 310 and adhesive).

The elongated member 304 may be either fixedly or removably attached to the cap collar 302. The elongated member has a first end 306 attached to the cap collar 302 and a second end 308 opposite thereto. The second end 308 may include an application device 122 such as a brush or sponge, to apply the cosmetic product. The application device 122 may be either fixedly or removably secured to the second end 308 of the elongated member 304. The application device 122 may be secured in any suitable manner (e.g., screw, adhesive, pressure fit, snap fit, etc.). In an embodiment, the application device 122 is removably secured to the elongated member 304 such that the application device 122 can be replaced by another application device of a same, similar, or different type.

Figure 4:
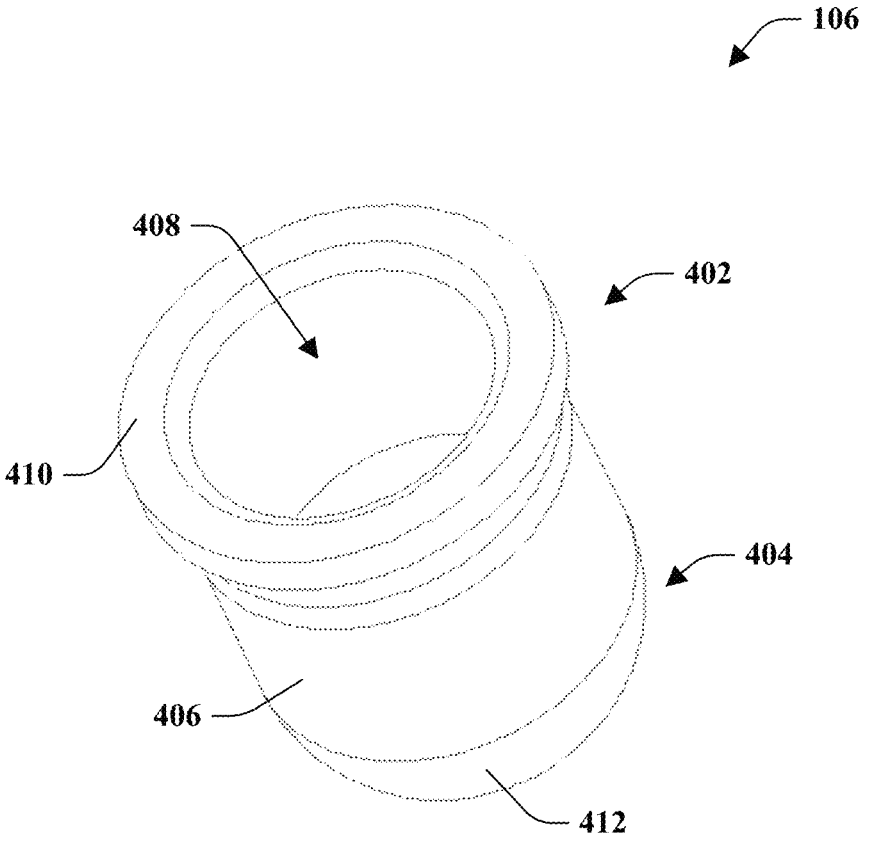
FIG. 4 is an example embodiment of a wiper of a cosmetic container device.

Turning to FIG. 4, an embodiment of the wiper 106 is shown. The wiper 106 includes a first end 402 and a second end 404 and a wiper body 406 having a throughpassage 408 extending from the first end 402 to the second end 404. The first end 402 may include a wiper collar 410 projecting outward from the wiper body 406 and the second end 404 may include a bevel 412 so that the wiper 106 may be easily inserted into inner capsule 110. In an example embodiment, the wiper 106 is partially inserted into an upper, open end of the inner capsule 110 during use and the wiper collar 410 may rest on a rim of the inner capsule 110 to prevent the wiper 106 from being fully inserted into the inner capsule 110. The wiper collar 410 may also serve as a seal between the inner capsule 110 and the inner cap 104 to prevent air from entering the inner capsule 110. In this way, the cosmetic product is prevented from drying out because of air exposure, for example. The wiper 106 may be formed of any suitable material, such as rubber, silicon, polychloroprene, or any other suitable material.

The elongated member 304 of the inner cap 104 may be inserted into the throughpassage 408 of the wiper 106 to create a seal between the wiper and the elongated member 304. In an embodiment, a diameter of the throughpassage 408 at a lower or bottom end may be similar or otherwise correspond to the diameter of the elongated member 304, such that the elongated member 304 contacts the interior surface of the wiper 106 while the outer cap 102 is attached to the exterior body 108, and one or more of the elongated member 304 or the application device 122 contacts the interior surface of the wiper 106 while the elongated member 304 is being removed (e.g., pulled) from the inner capsule 110. According to an embodiment, cosmetic product stored within the inner capsule 110 can adhere to the application device 122 while the application device 122 is inserted into the inner capsule 110, and the wiper 106 can be used to control (e.g., reduce) the amount of cosmetic product deposited onto the application device 122 as the elongated member 304 is being removed from the inner capsule 110.

Figure 5:
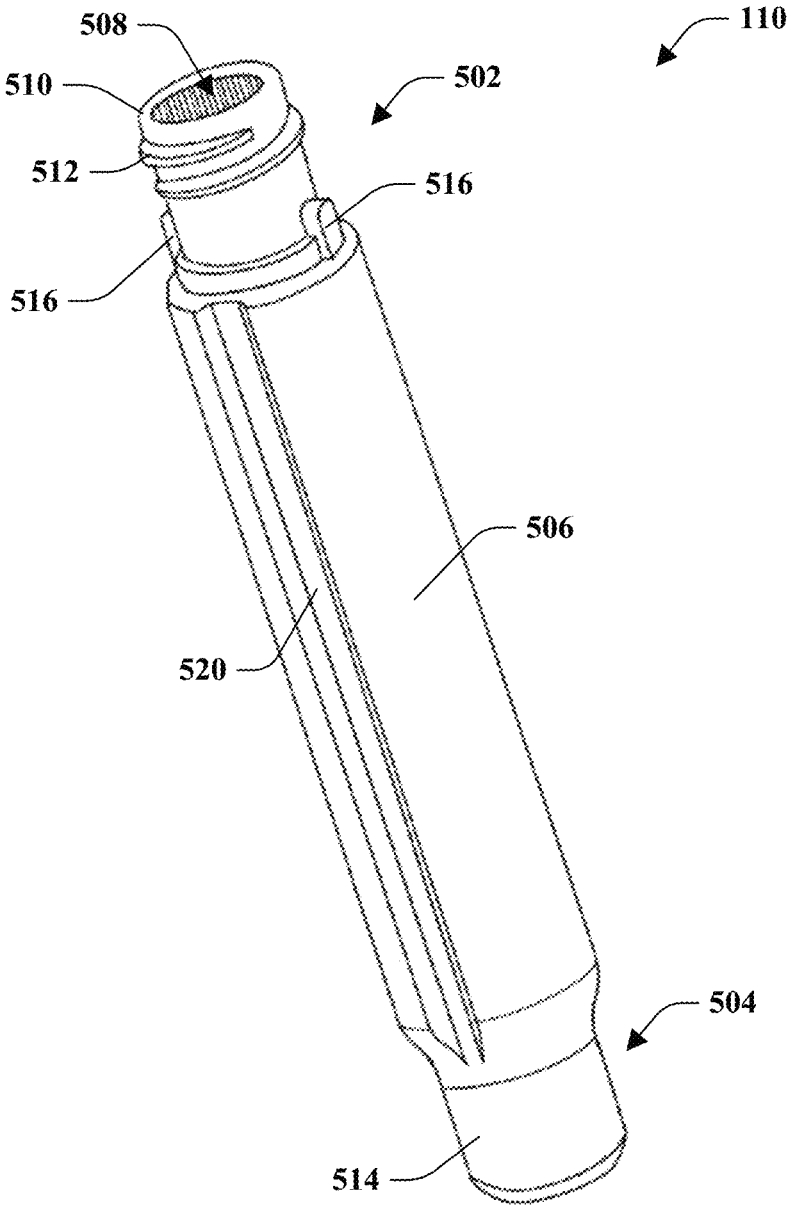
FIG. 5 is an example embodiment of an inner capsule of a cosmetic container device.

Turning to FIG. 5, an embodiment of the inner capsule 110 is shown. The inner capsule 110 may include a capsule body 506 having a first end 502 and a second end 504. The first end 502 may include a capsule collar 510 having an opening 508 that extends into a hollow cavity of the inner capsule 110 where cosmetic product may be stored. The second end 504 may be sealed or otherwise closed, to retain the cosmetic product within the inner capsule 110.

In an example embodiment, the capsule collar 510 at the first end 502 may include external threading 512 along an exterior surface of the inner capsule 110. The external threading 512 of the capsule collar 510 may engage with threading along an interior surface of the inner cap 104, for example when the inner cap 104 is secured to the outer cap 102, to removably couple the inner cap 104 to the inner capsule 110 and also secure the outer cap 102 to the exterior body 108 of the cosmetic container device 100. In an embodiment, securing the outer cap 102 to the exterior body 108 (i.e., by attaching internal threads of the inner cap 104 to the external threading 512 of the inner capsule 110) can prevent a cosmetic product from drying, expiring, or being exposed to dirt. Removal of the outer cap 102 may allow the contents of the inner capsule 110 to be accessed through the opening 508 of the inner capsule 110.

In another example embodiment, the inner capsule 110 may include one or more securing mechanisms for securing the inner capsule 110 within the exterior body 108 while the inner capsule 110 is installed therein. For example, the inner capsule 110 may include a plurality of notches 516. Notches 516 may engage with corresponding locations of the exterior body 108, for example when the inner capsule is installed in the exterior body 108. Notches 516 may prevent the inner capsule 110 from moving (e.g., rotating, spinning, etc.) while installed within the exterior body 108.

In another example embodiment, notches 516 may further aid in securing the outer cap 102 to the inner capsule 110. The notches 516 of the inner capsule 110 may engage with corresponding locations along an interior surface of the inner cap 104, for example when the inner cap 104 is secured to the outer cap 102, and further when the inner cap 104 is secured to the inner capsule 110. Notches 516 may allow the inner cap 104 to "snap" in place when the inner cap 104 is sufficiently threaded to the inner capsule 110. The "snap" may further indicate that the inner cap 104 is aligned with the inner capsule 110 or other components of the cosmetic container device 100.

In yet another example embodiment, there may be a plurality notches 516 of differing lengths. A first set of notches 516 may be longer than a second set of notches 516. The first set of notches 516 may extend at least partially into or through the exterior body 108 at one end and engage with corresponding locations along an interior surface of the inner cap 104 at an opposite end, to allow the inner cap 104 to "snap" in place when the inner cap 104 is sufficiently threaded to the inner capsule 110. The second set of notches 516 may be shorter than the first set of notches 516 and may engage with corresponding locations of the exterior body 108 to prevent the inner capsule 110 from moving (e.g., rotating, etc.) while installed within the exterior body 108.

In another example embodiment, the one or more securing mechanisms may include a channel-and-groove or other type of mechanism. For example, the inner capsule 110 may include a notch 520 extending between the first end and the second end, for example extending the length of the capsule body 506. The notch 520 may engage a location or corresponding notch on one or more of the exterior body 108 or collar 112 to prevent the inner capsule 110 from rotating inside the exterior body 108.

Figure 6:
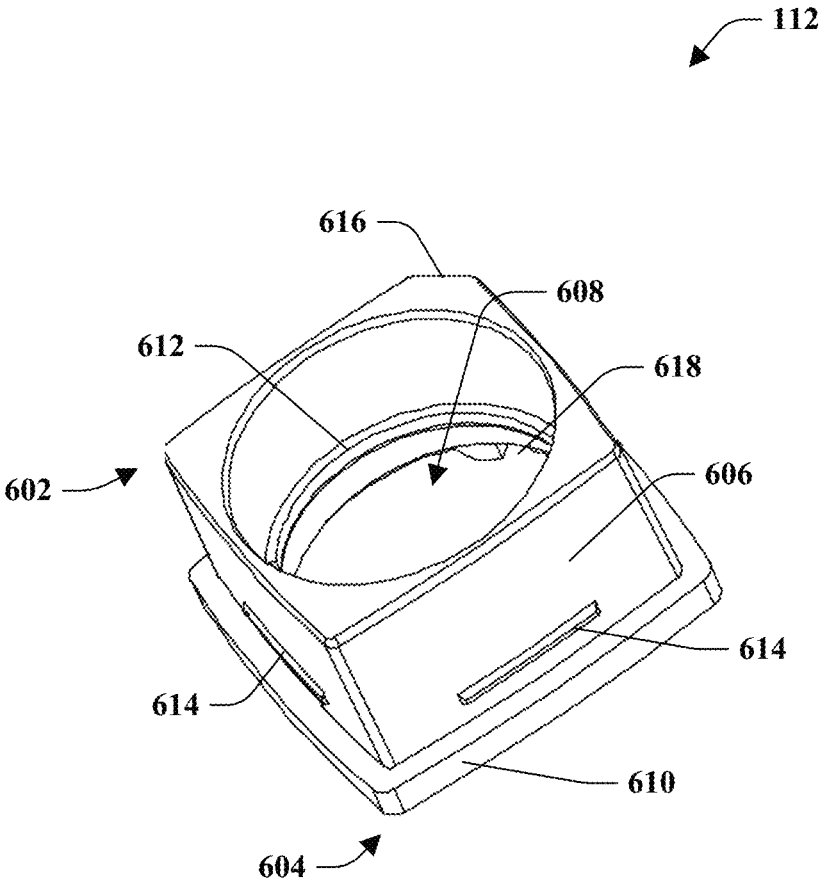
FIG. 6 is an example embodiment of a collar of a cosmetic container device.
Figure 7:
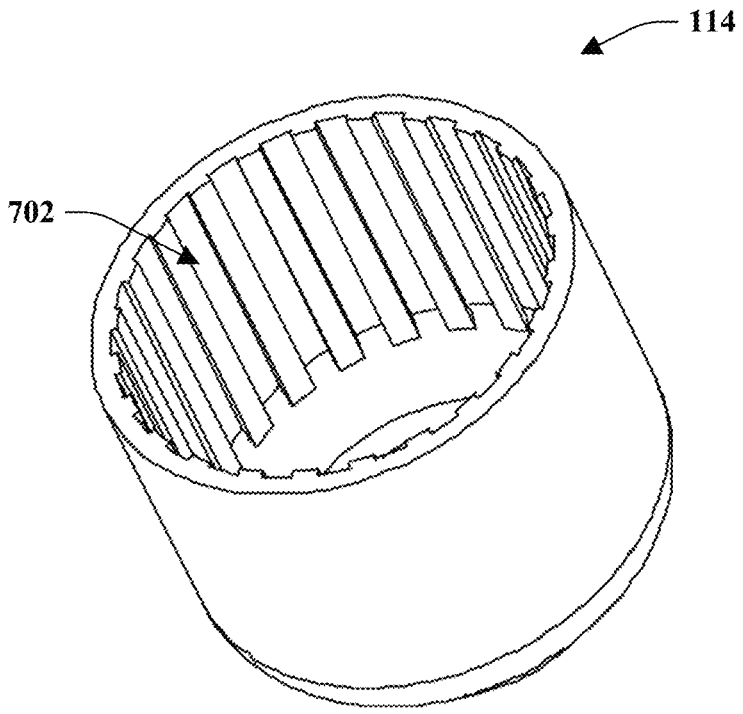
FIG. 7 is an example embodiment of an iron base of a cosmetic container device.
Figure 8:
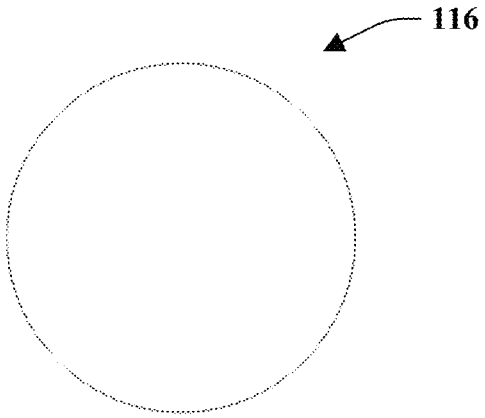
FIGS. 8 and 9 are example embodiments of an attachment device of a cosmetic container device.
Figure 9:
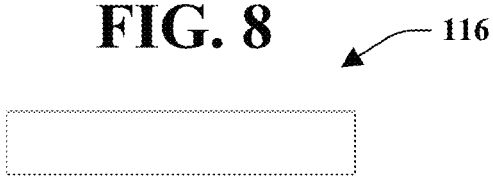
Figure 10:
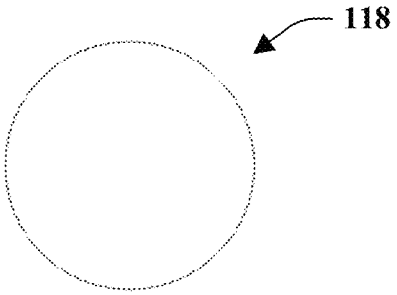
FIGS. 10 and 11 are example embodiments of a magnet of a cosmetic container device.
Figure 11:
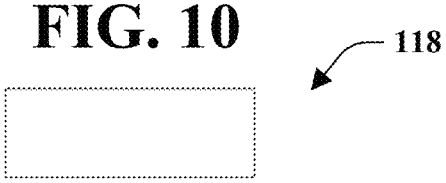

Turning to FIG. 6, an embodiment of a collar 112 is shown. The collar 112 may have a first end 602, a second end 604, a collar body 606 extending from the first end 602 to the second end 604, and a throughpassage 608 extending from the first end 602 to the second end 604. The collar body 606 may be shaped similar to the exterior body 108 of the cosmetic container device 100, or otherwise shaped so that the collar body 606 of the collar 112 may be inserted into the exterior body 108 of the cosmetic container device 100. The collar may be either fixedly or removably secured to the exterior body 108. In an example embodiment, the collar 112 may be formed as an integral piece of the exterior body 108.

In an example embodiment, an inner surface of the collar body 606 may include interior threading 612 that engages with exterior threading of the end cap 120 to removably couple the end cap 120 to the exterior body 108. In an embodiment, the threading may removably couple the end cap 120 to the collar 112, and the collar 112 may be secured to the exterior body 108. The collar may also include a rim 610 at the second end 604. The rim 610 may fit between the exterior body 108 and the end cap 120, and may be visible or hidden from an exterior view.

In another example embodiment, the collar 112 may include a plurality of notches 614. The notches 614 may engage a location of the exterior body 108 to secure the collar 112 to the exterior body 108. The collar 112 may be secured in any suitable manner (e.g., adhesive, pressure fit, snap fit, etc.).

In another example embodiment, the collar 112 may include a second notch 616. The second notch may engage a location of the exterior body 108 to ensure that the collar 112 is inserted into the exterior body 108 in a preferred orientation. To insert the collar 112 into the exterior body 108, a user may align the second notch 616 of the collar 112 with a corresponding location of the exterior body 108.

In yet another example embodiment, a third notch 618 of the collar 112 may engage a location of the end cap 120 to prevent the end cap 120 from disengaging (i.e., unscrewing from the exterior body 108, etc.). When the end cap 120 is sufficiently screwed to the exterior body 108, the collar may "snap" in place when the third notch 618 engages with a location of the end cap 120. The "snap" may indicate that the end cap 120 is securely fastened to the exterior body 108 and that the end cap 120 is aligned with the exterior body 108.

Turning to FIGS. 7-11, example fixation devices 114, 116, 118 are shown. The fixation devices 114, 116, 118 may be formed of a ferrous metal, magnetic metal such as iron or neodymium, or any other similar material. In an example embodiment, fixation devices 114, 118 are formed from a ferrous metal such as iron and fixation device 116 is formed from a magnetic metal such as neodymium. Fixation device 118 may be secured to the end cap 120 and fixation device 114 may be secured to the second end 504 of the inner capsule 110. Fixation device 116 may be placed between fixation devices 114 and 118 to secure the inner capsule 110 to the end cap 120 (e.g., to prevent movement, etc.) by way of the magnetic attraction between the fixation devices 114, 116, 118. The fixation device 116 may be secured to one or more of the fixation devices 114 and 118. Fixation devices 114, 116, 118 may also allow the inner capsule 110 to be installed more easily by allowing a user to install the inner capsule by, for example, placing the inner capsule 110 on the end cap 120, thereby securing the inner capsule 110 to the end cap 120 via the one or more fixation devices, without having to grasp the inner capsule 110 to hold it in place, and then inserting the secured end cap 120 and inner capsule 110 assembly into the exterior body 108.

In an example embodiment, the fixation device 114 may be an iron member, at least a portion of which is formed of a ferrous material, such as an iron base secured to the second end 504 of the inner capsule 110. The iron base may be a similar shape and/or correspond to a shape of the second end 504 of the inner capsule 110. The iron base may be secured, either removably or fixedly, to the inner capsule 110 in any suitable manner (e.g., snap fit, adhesive, pressure fit, crimping, etc.) The iron base may be secured, by way of magnetic attraction, to fixation devices 116, 118. The iron base may allow the inner capsule 110 to be installed more easily by allowing a user to, for example, place the inner capsule 110 (with iron base) on the end cap 120. A user may thereby removably secure the inner capsule 110 to the end cap 120 via the one or more fixation devices and the iron base, without having to grasp the inner capsule 110 to hold it in place, and then may insert the secured end cap 120 and inner capsule 110 assembly into the exterior body 108.

In an example embodiment, the fixation device 114 is formed of a non-ferrous material. Fixation device 114 may be crimped to the second end 504 of the inner capsule 110 to secure the fixation device 114 to the inner capsule 110. Fixation device 114 may include ribs 702 to allow the fixation device 114 to better grip the inner capsule 110. A second device formed of a ferrous material may then be secured to the fixation device 114, and may secure the fixation device 114 to fixation devices 116, 118 by way of magnetic attraction.

In another example embodiment, there may be only two fixation devices, one attached to the end cap 120 and the other attached to the inner capsule 110. Each fixation device may be formed of a magnetic metal such as neodymium and may secure the inner capsule 110 to the end cap 120 through the magnetic attraction between each fixation device. It should be appreciated that any number or combination of fixation devices of any material may be used to secure various elements of the cosmetic container device 100 or that fixation devices need not be used at all. For example, at least a portion of the inner capsule 110 or the end cap 120 can be formed of a metallic material, such that a magnetic fixation device can be placed in the other of the inner capsule 110 or the end cap 120, to secure the inner capsule 110 to the end cap 120. As another example, an adhesive may be used to secure the inner capsule to the end cap. The adhesive may be a non-permanent adhesive to allow the inner capsule to be detached from the end cap.

Figure 12:
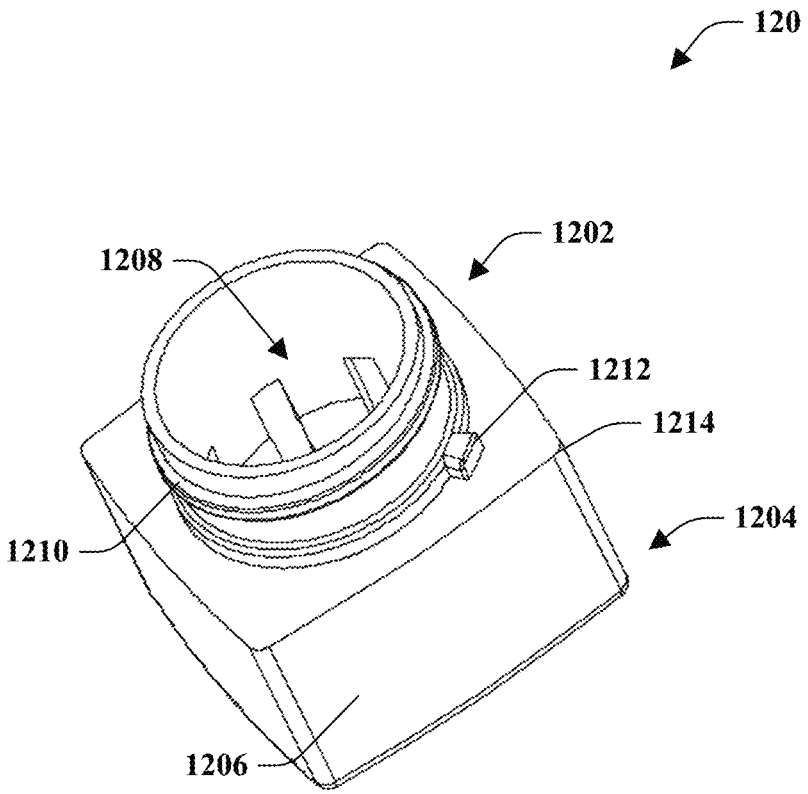
FIG. 12 is an example embodiment of an end cap of a cosmetic container device.

Turning to FIG. 12, an embodiment of an end cap 120 is shown. The end cap 120 may include a first end 1202, a second end 1204, and a body 1206 extending between the first end 1202 and the second end 1204. The end cap 120 may include an opening 1208 at the first end 1202. A fixation device 114, 116, 118 may be secured to the end cap 120 at a location through the opening 1208. For example, the fixation device 114, 116, 118 may be secured to an inner surface of the end cap 120.

In an example embodiment, the end cap 120 may include threading 1210 at the first end 1202. The threading 1210 may engage with the threading 612 of the collar 112 to secure the end cap 120 to the exterior body 108 of the cosmetic container device 100. The end cap 120 may also include a notch 1212 that may engage a location or corresponding notch 618 of one or more of the collar 112 or the exterior body 108, to securely fasten the end cap 120 to the collar 112 or the exterior body 108. The engagement between the location or corresponding notch 618 and notch 1212 together may form a snap fit that creates a "snap" sound when engaged, to indicate that the end cap 120 is secured and aligned correctly with the exterior body 108.

In an example embodiment, the end cap 120 and the exterior body 108 of the cosmetic container device 100 are square or substantially square in shape. The notch 1212 may ensure that the corners 1214 of the end cap 120 are aligned with the corners of the exterior body 108. It should be appreciated that a notch 1212 may be used to the same effect for an end cap 120 and exterior body 108 having any suitable shape. In another example embodiment, the exterior body 108 and the end cap 120 may be circular or cylindrical, and the end cap 120 may include a notch 1212. While the notch 1212 may not be needed to align the end cap 120 and the exterior body 108, the notch 1212 may ensure that the end cap 120 is securely fastened to the exterior body 108. Similarly, it should be appreciated the notch 1212 need not be used at all, or that any similar method of alignment may be used.

Figure 13:
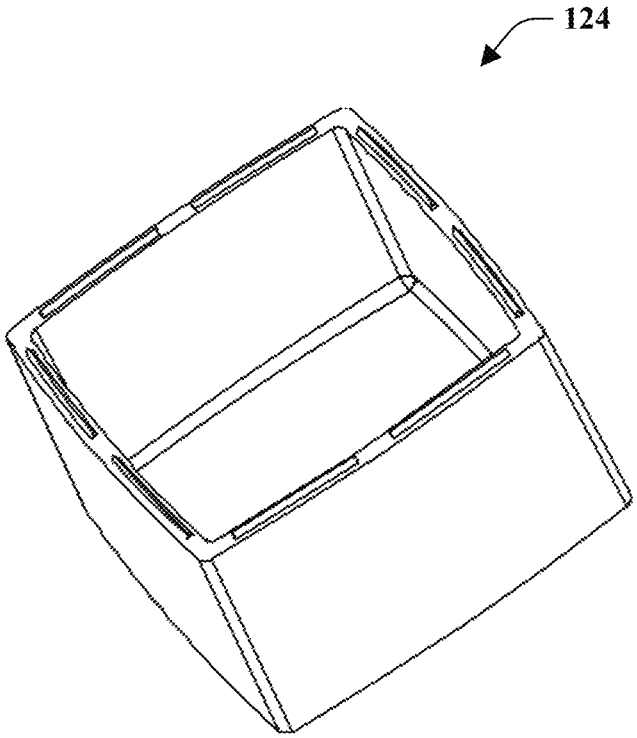
FIG. 13 is an example embodiment of an inner base of a cosmetic container device.

Turning to FIG. 13, an inner base 124 is shown. The inner base 124 may be secured to the end cap 120 for structural or aesthetic reasons, for example to provide a smooth exterior appearance to the bottom of the cosmetic container device. In an embodiment, the inner base 124 may be plastic welded to the end cap 120.

Figure 14:
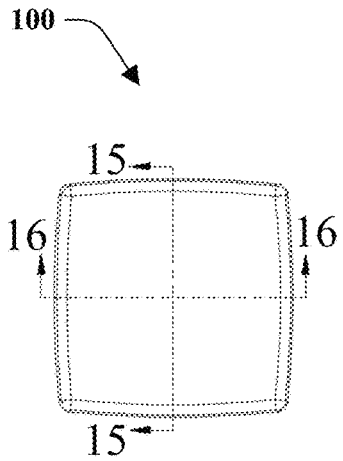
FIG. 14 is a top view of a cosmetic container device according to an embodiment.
Figure 15:
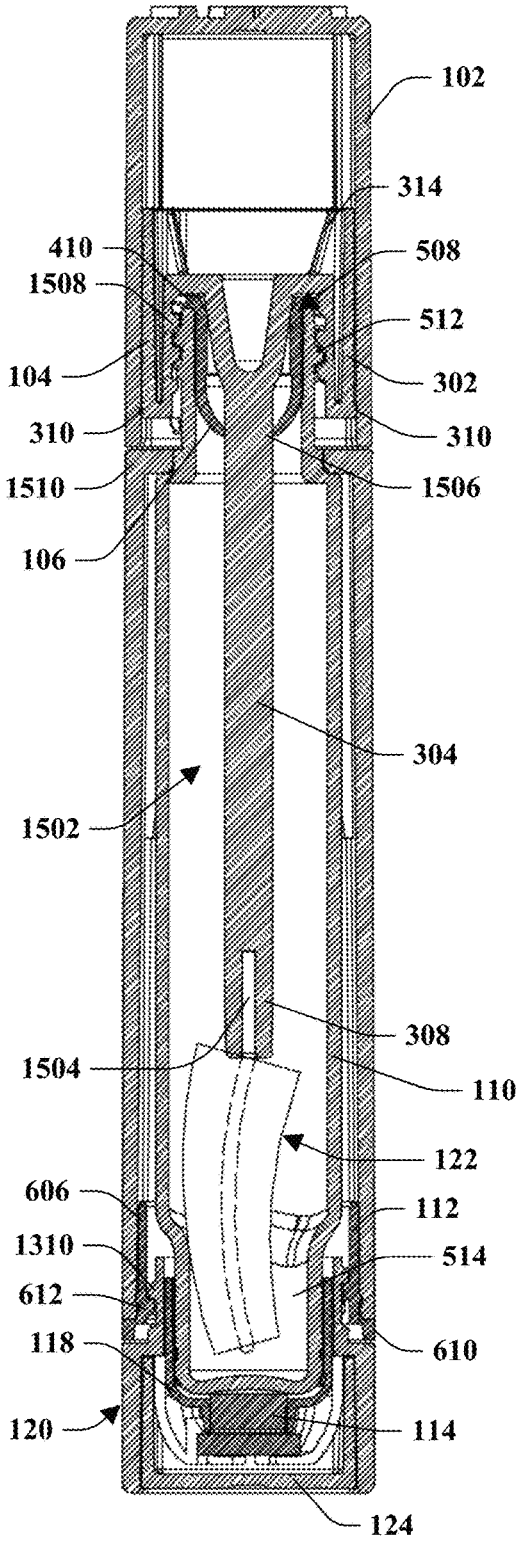
FIG. 15 is a cross sectional view of the cosmetic container device taken at line 15-15 in FIG. 14.
Figure 16:
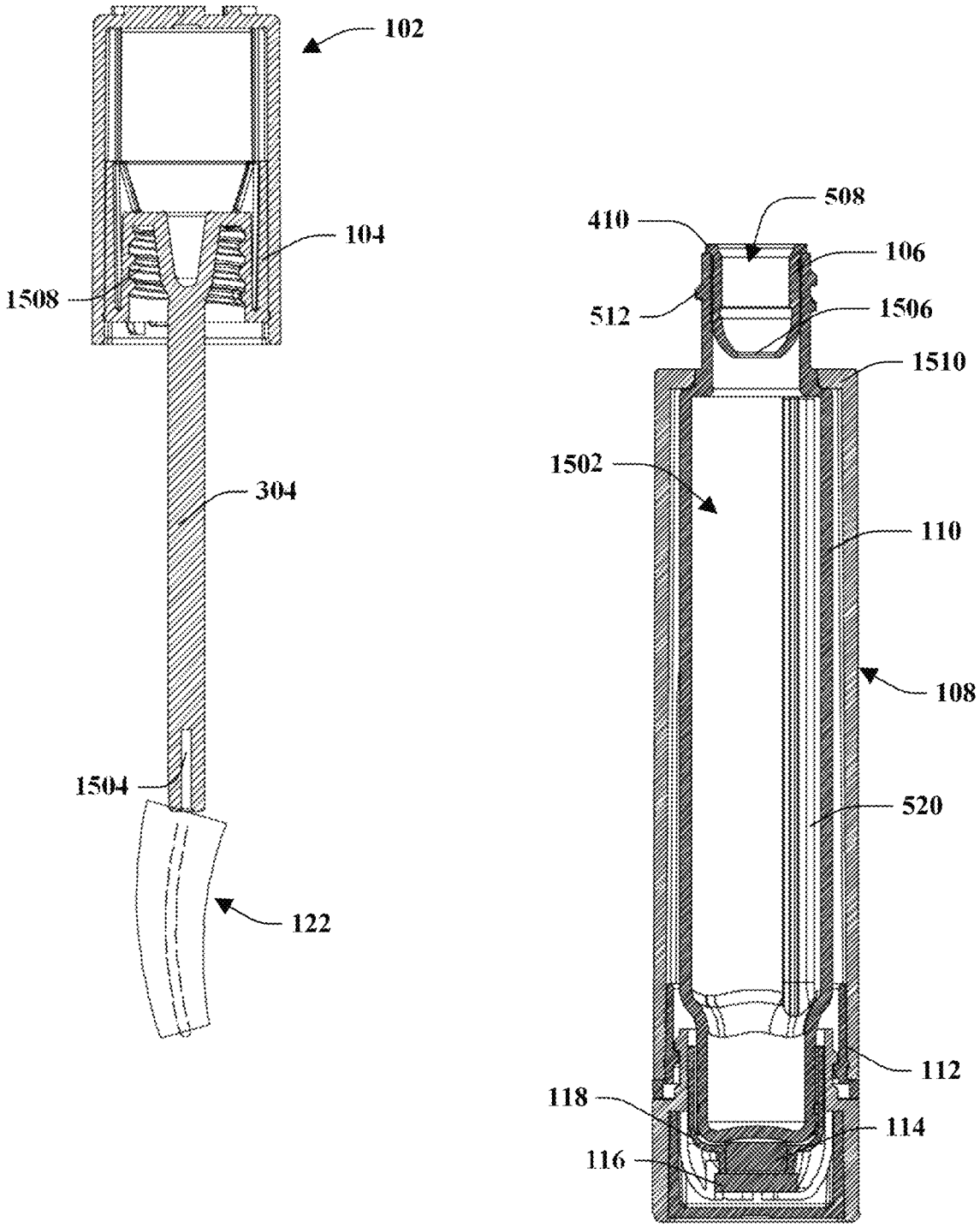
FIG. 16 is a cross sectional view of the cosmetic container device taken at line 16-16 in FIG. 14.

Turning to FIGS. 15 and 16, cross sectional views are shown as taken from FIG. 14. FIG. 15 shows an example embodiment of the cosmetic container device 100 with the outer cap 102 attached to the exterior body 108. FIG. 16 shows an example embodiment of the cosmetic container device 100 with the outer cap 102 removed from the exterior body 108.

In an example embodiment, a cavity 1502 of the inner capsule 110 may store a cosmetic product. The exterior body 108 may include a shoulder 1510 at its first end, extending in a direction substantially perpendicular to the length of the exterior body 108 and configured to abut an outer surface of the inner capsule 110, to prevent the inner capsule 110 from being removed from the exterior body 108 through the opening in the first end. The cosmetic product may be accessed through the opening 508 of the inner capsule 110 (e.g., when the outer cap 102 is removed from the exterior body 108). As shown in FIG. 15, the elongated member 304 of the inner cap 104 may be received within the cavity 1502 while the outer cap 102 is attached to the exterior body 108.

The second end 308 of the elongated member 304 may include an opening 1504 for receiving an application device 122. The application device 122 may be fixedly or removably attached to the elongated member 304 using the opening 1504. At least a portion of the application device 122 may be inserted into the opening 1504 to attach the application device 122 to the elongated member 304. It should be appreciated that the application device 122 may be installed or coupled to the elongated member 304 using any suitable method or procedure (e.g., adhesive, pressure fit, snap fit, screw on, etc.).

In an example embodiment, the application device 122 is a brush with a proximal end similar in shape and size to the opening 1504. The proximal end of the brush may be inserted into the opening 1504 to attach the brush to the elongated member 304. The brush may be removed, replaced, and attached as desired. The brush may remain attached to the elongated member 304 when the outer cap 102 is attached to the exterior body 108 or the brush may be removed from the elongated member 304 before the outer cap 102 is attached to the exterior body. Removing the brush may permit, for example, application devices of various shapes and sizes to be installed in its place.

In an example embodiment, the brush may be permanently attached to the inner cap 104. To replace or change the brush, a user may replace the inner cap 104 with a second inner cap having a different brush. It should be appreciated that the brush may be replaced at any time by either replacing the brush alone or by replacing the whole inner cap 104, for example.

In another example embodiment, the application device 122 may be removed and replaced as required to match a type of cosmetic product in the inner capsule 110. When an inner capsule 110 is replaced or refilled, the application device 122 (e.g., brush or similar device) may also be replaced. Different cosmetic products require different application devices 122 to allow for proper application. Similarly, cosmetic products may be different shades of color, and different application devices 122 may be used for different shades of cosmetic product.

The wiper 106 may rest or be received within the opening 508 of the inner capsule 110. As shown in FIGS. 15 and 16, the wiper collar 410 of the wiper 106 may rest at the opening 508 to prevent the wiper 106 from being fully inserted into the cavity 1502. The wiper 106 may create a seal between the inner cap 104 and the first end 502 of the inner capsule 110 to prevent cosmetic product from exiting the cavity 1502 while the outer cap 102 is being attached to the exterior body 108.

The wiper 106 may have an opening 1506 that the elongated member 304 may be inserted through. The opening 1506 may create a seal between the wiper 106 and the elongated member 304 to prevent cosmetic product from leaving the cavity 1052 while the outer cap 102 is being attached to the exterior body 108. The diameter of the opening 1506 at the lower or bottom end may be similar or otherwise correspond to the diameter of the elongated member 304, such that the elongated member 304 contacts the interior surface of the wiper 106 while the outer cap 102 is attached to the exterior body 108. Additionally, one or more of the elongated member 304 or the application device 122 may contact the inner surface of the wiper 106 at the opening 1506 while the elongated member is being removed from the inner capsule 110. The wiper 106 may be formed of a flexible material such that the wiper 106 may flex and create an efficient seal between the wiper 106 and the inner cap 104.

According to an embodiment, cosmetic product may be stored in the cavity 1502 of the inner capsule 110 and may adhere to the elongated member 304 or the application device 122 while the elongated member 304 and the application device 122 are inserted into the cavity 1502. The wiper 106 may be used to control the amount of cosmetic product deposited onto the application device 122 as the elongated member 304 is being removed from the inner capsule 110 (e.g., as the elongated member 304 contacts the inner surface of the wiper 106 at the opening 1506).

In an example embodiment shown in FIGS. 15 and 16, the inner cap 104 may include threading 1508 on an interior surface of the inner cap 104 to couple with exterior threading 512 of the inner capsule 110. The threading 1508 may engage the threading 512 to removably attached the outer cap 102 to the exterior body 108 of the cosmetic container device 100. It should be appreciated that the outer cap 102 may be removably attached to the exterior body 108 in a manner other than threading. For example, the outer cap 102 may be attached using a snap on or pressure fit lid.

Turning to FIGS. 17-21, an example embodiment of an outer cap 102 is shown. The outer cap 102 may be rectangular with a hollow cavity 2004. The inner cap 104 may be inserted into the cavity 2004 and secured in place. In an example embodiment, the inner cap 104 is secured in place using slots 2002 that engage with the notches 310 of the inner cap 104. In another example embodiment, the inner cap 104 is secured into the cavity 2004 by pressure fit, adhesive, threading, or any suitable manner.

Figure 17:
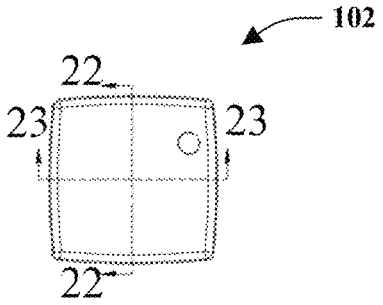
FIG. 17 is a top view of a cap of a cosmetic container device according to an embodiment.
Figure 18:
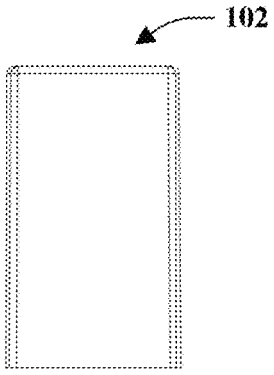
FIG. 18 is a side view of the cap of the cosmetic container device according to an embodiment.
Figure 19:
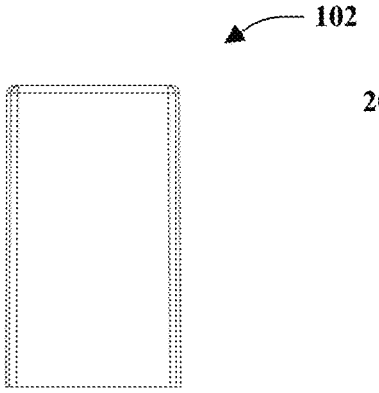
FIG. 19 is a front view of the cap of the cosmetic container device according to an embodiment.
Figure 20:
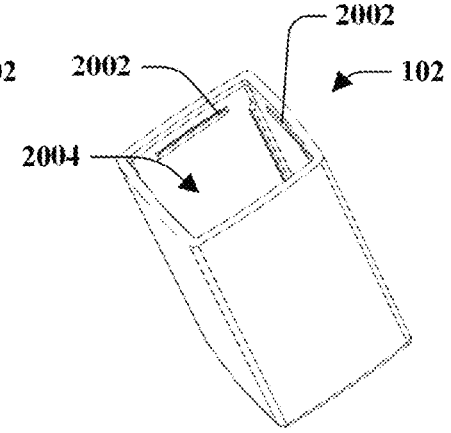
FIG. 20 is bottom perspective view of the cap of the cosmetic container device according to an embodiment.
Figure 21:
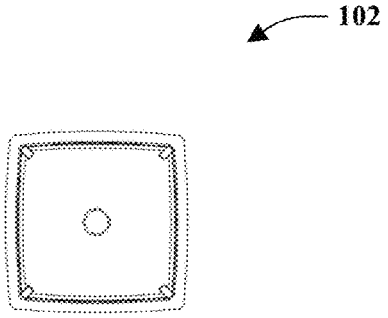
FIG. 21 is a bottom view of the cap of the cosmetic container device according to an embodiment.
Figure 22:
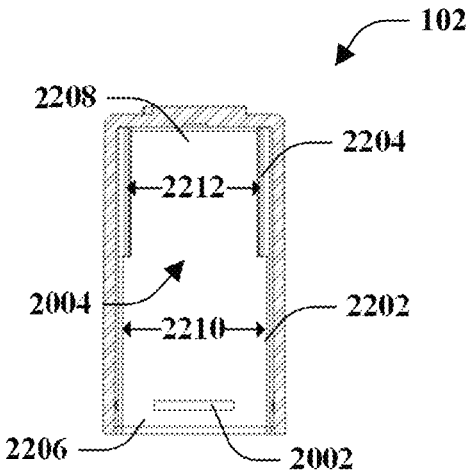
FIG. 22 is a cross sectional view of the cap of the cosmetic container device taken at line 22-22 of FIG. 17.
Figure 23:
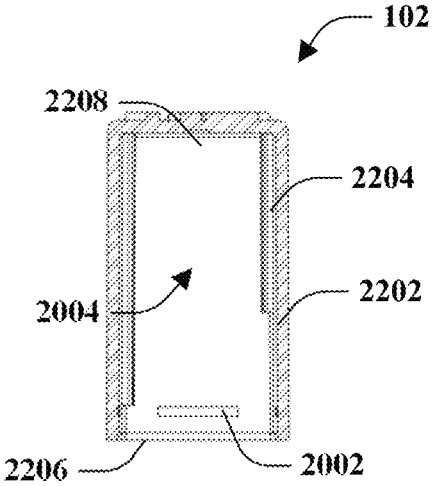
FIG. 23 is a cross sectional view of the cap of the cosmetic container device taken at line 23-23 of FIG. 17.

Turning to FIGS. 22-23, cross sectional views of an outer cap 102 are shown as taken from lines 22-22 and 23-23 from FIG. 17. The cap may have an open end 2206 and a closed end 2208. The outer cap 102 may include a first portion 2202 at the open end 2206, and a second portion 2204 at the closed end 2208. The first portion 2202 may be shaped and sized according to the body 302 of the inner cap 104, such that the body 302 may fit into and be secured at the first portion 2202. The second portion 2204 may be shaped and sized such that the body 302 will not fit into the second portion 2204. The second portion may prevent the body 302 from moving from the first portion 2202 to the second portion 2204 (for example, the inner diameter 2210 of the first portion 2202 may be less than the inner diameter 2212 of the second portion 2204).

Turning to FIGS. 24-27, an example embodiment of an inner cap 104 is shown. Notches 310 may engage with slots 2002 of the outer cap 102 to secure the inner cap 104 to the outer cap 102. Additionally, inner cap 104 may include notch 2402 that may engage with a location of the outer cap 102 to ensure proper alignment.

In another embodiment, inner cap 104 may include notches 2502 to engage with corresponding notches 516 of the inner capsule 110. Notches 2502 may ensure proper alignment of the inner capsule 110 and exterior body 108 to the inner cap 104. Additionally, the notches 2502 may prevent movement of the inner cap 104 in relation to other features of the cosmetic container device 100 (e.g., the exterior body 108, the inner capsule 110, etc.)

Figure 24:
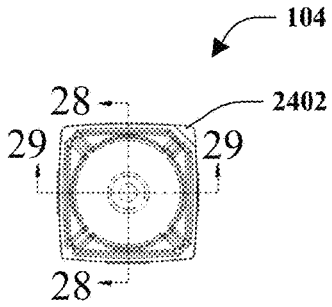
FIG. 24 is a top view of an inner cap of a cosmetic container device according to an embodiment.
Figure 25:
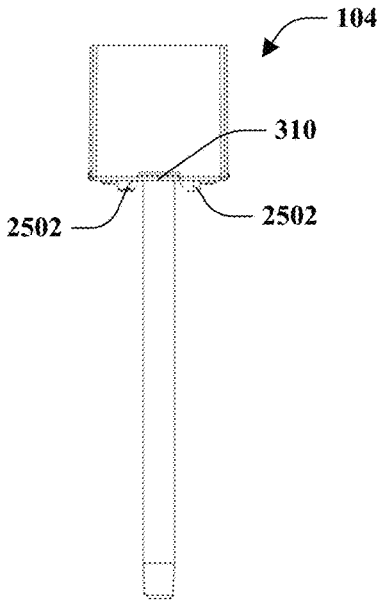
FIG. 25 is a side view of the inner cap according to an embodiment.
Figure 26:
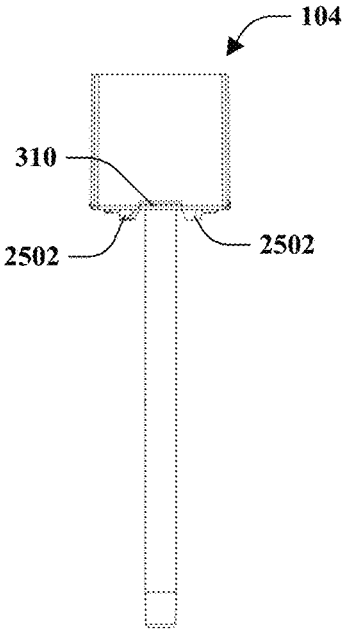
FIG. 26 is a front view of the inner cap according to an embodiment.
Figure 27:
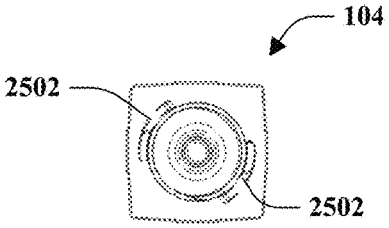
FIG. 27 is a bottom view of the inner cap according to an embodiment.
Figure 28:
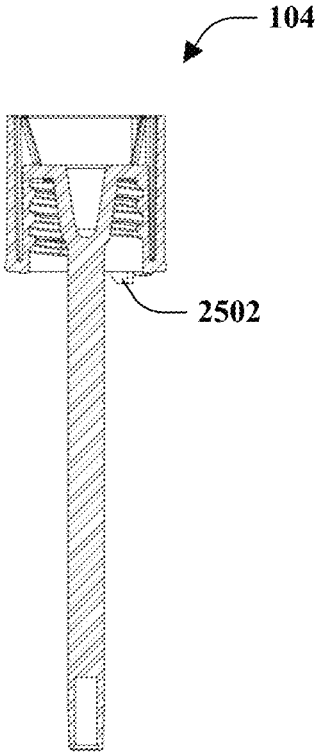
FIG. 28 is a cross sectional view of the inner cap taken at line 28-28 of FIG. 24.
Figure 29:
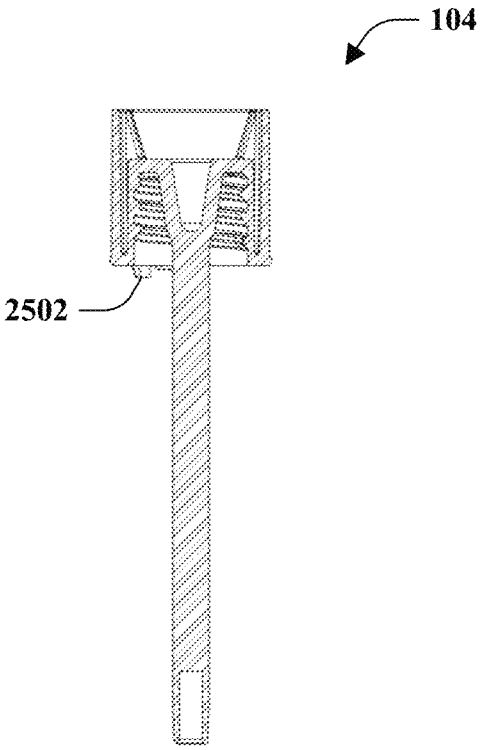
FIG. 29 is a cross sectional view of the inner cap taken at line 29-29 of FIG. 24.
Figure 30:
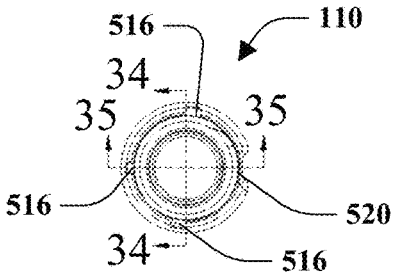
FIG. 30 is a top view of an inner capsule of a cosmetic container device according to an embodiment.
Figure 31:
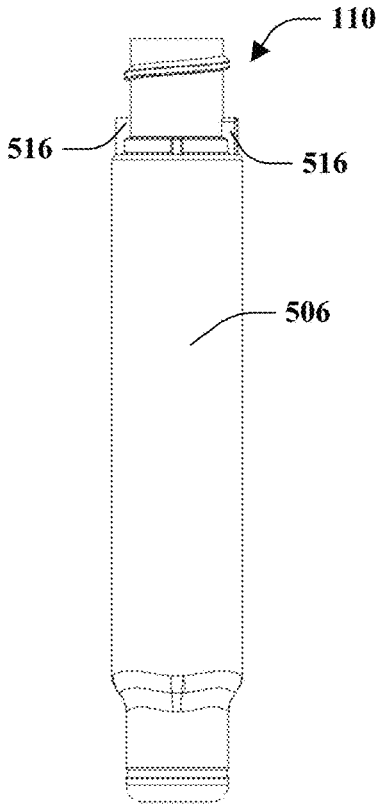
FIG. 31 is a side view of the inner capsule according to an embodiment.
Figure 32:
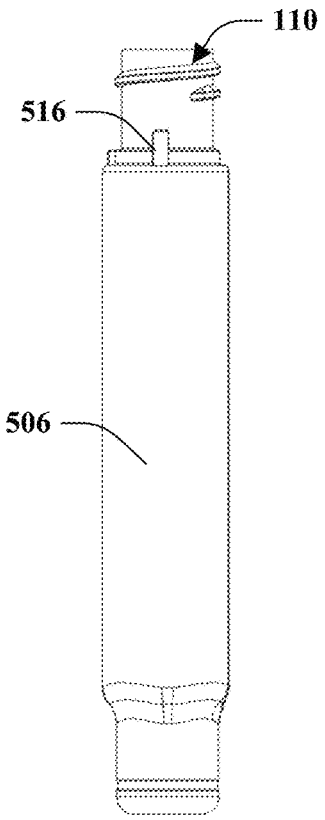
FIG. 32 is a front view of the inner capsule according to an embodiment.
Figure 33:
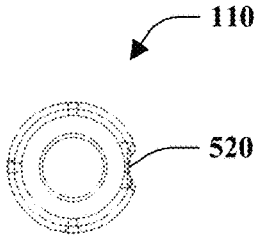
FIG. 33 is a bottom view of the inner capsule according to an embodiment.

FIGS. 28-29 are cross sectional views of the inner cap 104 taken from lines 28-28 and 29-29 of FIG. 24.

Figure 34:
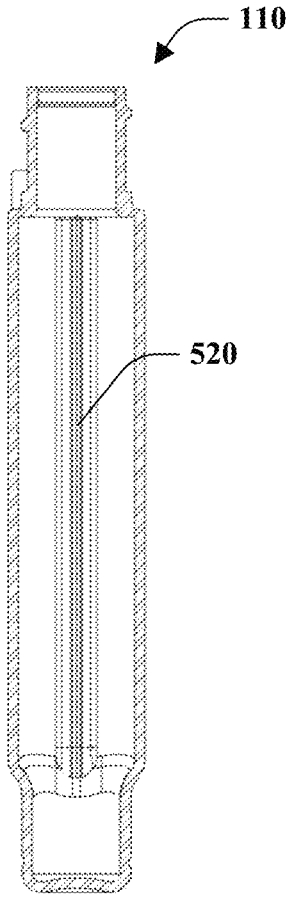
FIG. 34 is a cross sectional view of the inner capsule taken at line 34-34 of FIG. 30.
Figure 35:
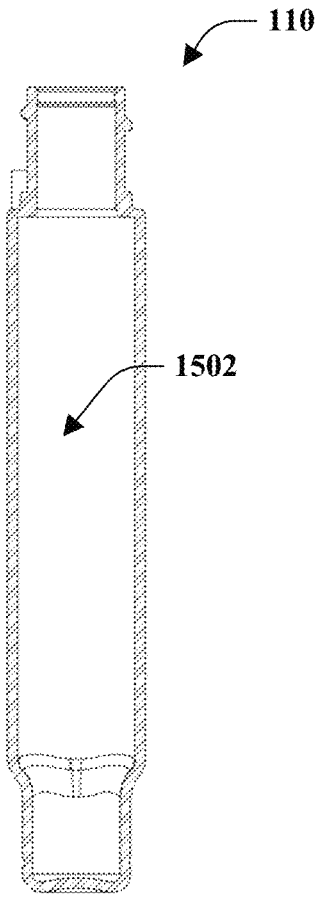
FIG. 35 is a cross sectional view of the inner capsule taken at line 35-35 of FIG. 30.
Figure 36:
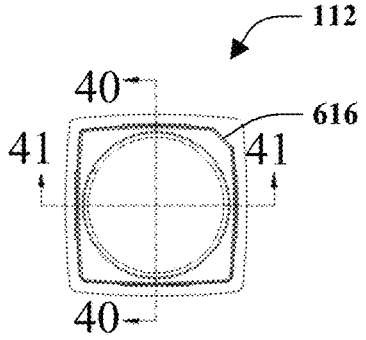
FIG. 36 is a top view of a collar of a cosmetic container device according to an embodiment.
Figure 37:
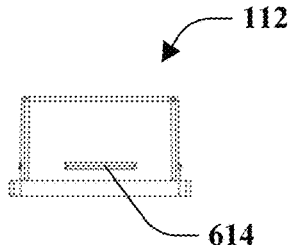
FIG. 37 is a side view of the collar according to an embodiment.
Figure 38:
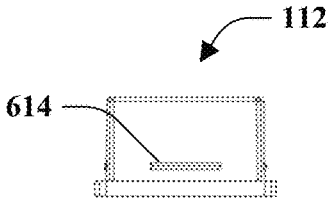
FIG. 38 is a front view of the collar according to an embodiment.
Figure 39:
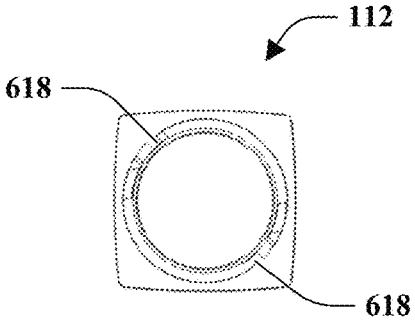
FIG. 39 is a bottom view of the collar according to an embodiment.

Turning to FIGS. 30-33, an example embodiment of an inner capsule 110 is shown. The inner capsule 110 may include a main body portion comprising the capsule body 506, having a first end and a second end, and defining a cavity. The inner capsule 110 may include a notch 520 extending between the first end and the second end, for example extending the length of the capsule body 506. The notch 520 may engage a location or corresponding notch on one or more of the exterior body 108 or collar 112 to prevent the inner capsule 110 from rotating inside the exterior body 108. For example, notch 520 may engage with corresponding notches of the collar 112 or the exterior body 108 to ensure that the inner capsule 110 is installed in a proper rotational alignment or other orientation and also to prevent rotational movement of the inner capsule 110. The inner capsule 110 may further include a top end portion extending from the first end of the main body portion and defining an open end, and having threads on an outer surface thereof. The diameter of the top end portion may be less than the diameter of the main body portion. The inner capsule 110 may further include a bottom end portion extending from the second end of the main body portion and defining a closed end. In an embodiment, the bottom end portion may have a diameter less than the diameter of the main body portion. In an embodiment, the bottom end portion may include one or more cavities or indentations in a bottom surface thereof, for receiving one or more fixation devices for securing the inner capsule 110 to the end cap 120. In another embodiment, an iron member such as an iron base may be secured to the bottom end portion of the inner capsule 110, to removably secure the inner capsule 110 to the end cap 120. FIGS. 34-35 are cross sectional views of the inner capsule 110 taken from lines 34-34 and 35-35 of FIG. 30.

Figure 40:
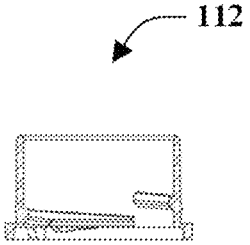
FIG. 40 is a cross sectional view of the collar taken at line 40-40 of FIG. 36.
Figure 41:
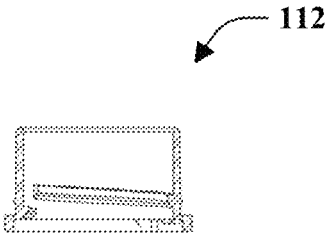
FIG. 41 is a cross sectional view of the collar taken at line 41-41 of FIG. 36.
Figure 42:
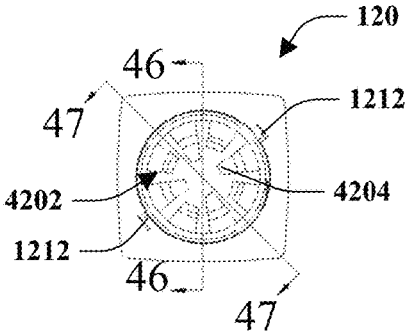
FIG. 42 is a top view of an end cap of a cosmetic container device according to an embodiment.
Figure 43:
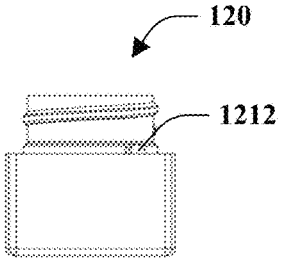
FIG. 43 is a side view of the end cap according to an embodiment.
Figure 44:
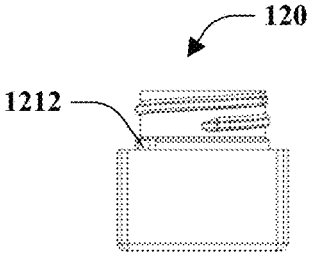
FIG. 44 is a front view of the end cap according to an embodiment.
Figure 45:
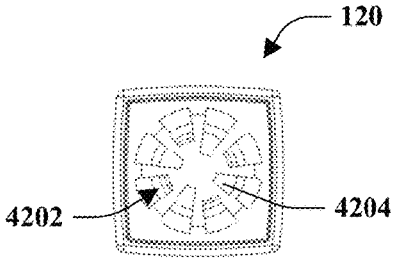
FIG. 45 is a bottom view of the end cap according to an embodiment.

FIGS. 36-39 show an example embodiment of a collar 112. FIGS. 40-41 show a cross sectional view of a collar 112 taken from lines 40-40 and 41-41 of FIG. 36.

FIGS. 42-45 show an example embodiment of an end cap 120. Notch 1212 may engage a corresponding notch 618 of the collar 112 to secure the end cap 120 to the collar 112. When the end cap 120 is sufficiently screwed to the exterior body 108, the collar may "snap" in place when notch 618 engages with notch 1212 of the end cap 120. The "snap" may indicate that the end cap 120 is securely fastened to the exterior body 108 and that the end cap 120 is aligned with the exterior body 108.

In an embodiment, end cap 120 includes a spring member 4202. A first fixation device may be secured to the end cap 120 at the spring 4202. For example, the spring 4202 may hold a magnet in place within the end cap 120. The spring member 4202 may allow the first fixation device to remain sufficiently pressed against a second fixation device secured to the inner capsule 110. The spring member 4202 may include a latch 4204 to securely fasten the first fixation device to the spring member 4202. However, embodiments are not limited thereto, and any suitable device for occupying the vertical space between the first fixation device and the second fixation device and holding them in a coupled configuration may be used.

Figure 46:
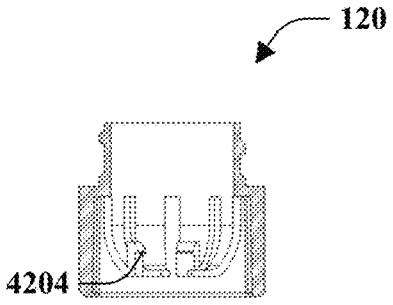
FIG. 46 is a cross sectional view of the end cap taken at line 46-46 of FIG. 42.
Figure 47:
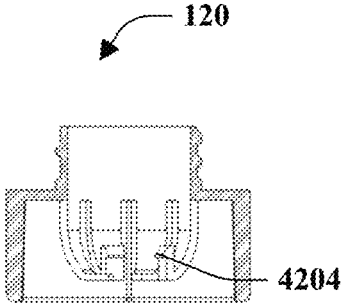
FIG. 47 is a cross sectional view of the end cap taken at line 47-47 of FIG. 42.
Figure 48:
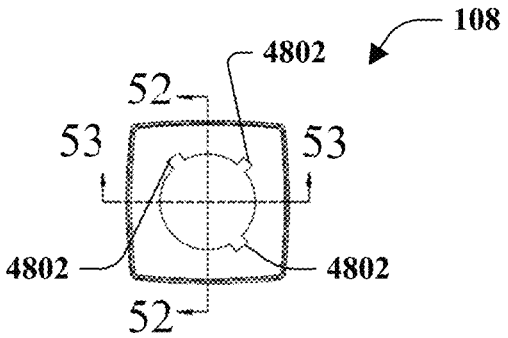
FIG. 48 is a top view of an exterior body of a cosmetic container device according to an embodiment.
Figure 49:
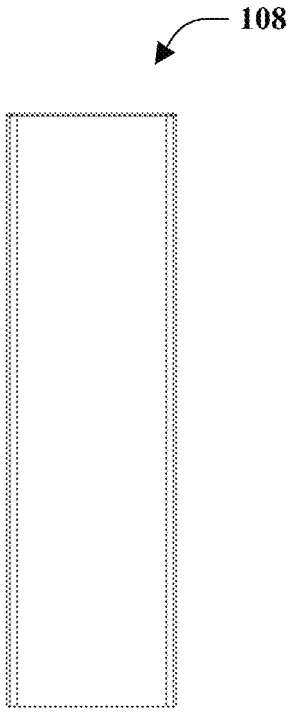
FIG. 49 is a left view of an exterior body of a cosmetic container device according to an embodiment.
Figure 50:
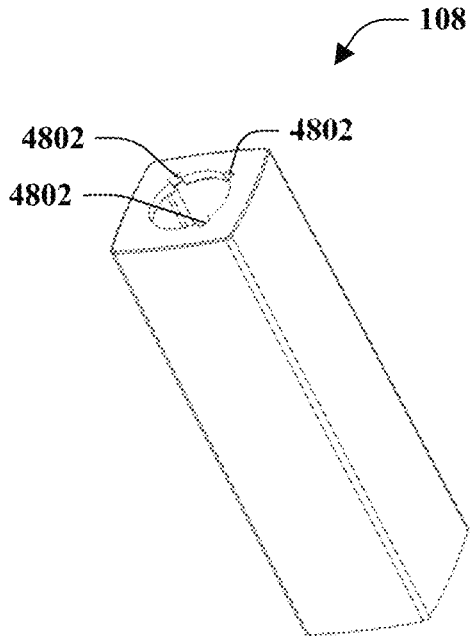
FIG. 50 is a perspective view of an exterior body of a cosmetic container device according to an embodiment.
Figure 51:
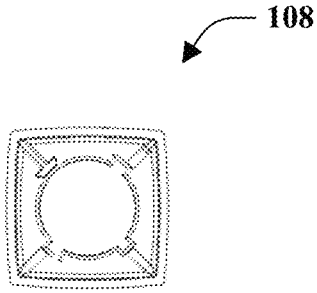
FIG. 51 is a bottom view of an exterior body of a cosmetic container device according to an embodiment.

FIGS. 46-47 show a cross sectional view of an end cap 120 taken from lines 46-46 and 47-47 of FIG. 40.

Figure 52:
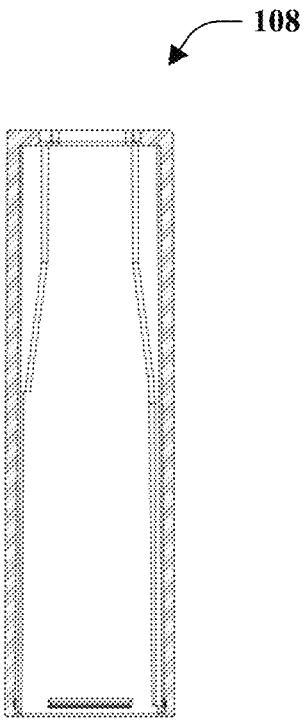
FIG. 52 is a cross sectional view of the exterior body taken at line 52-52 of FIG. 48.
Figure 53:
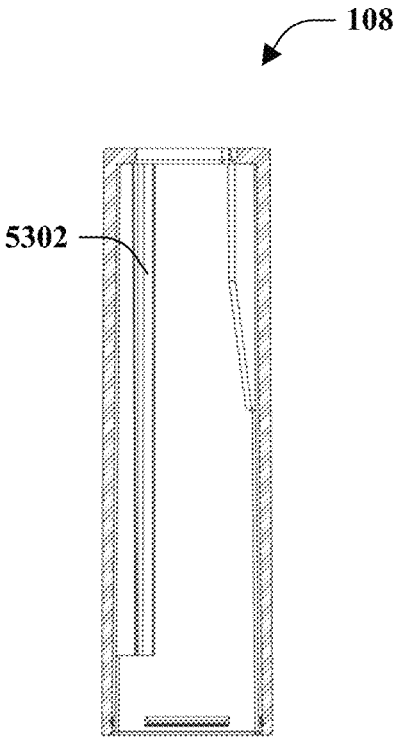
FIG. 53 is a cross sectional view of the exterior body taken at line 53-53 of FIG. 48.

FIGS. 48-51 show an example embodiment of an end cap exterior body 108. Notches 4802 may engage corresponding notches 516 of the inner capsule 110 and may ensure correct alignment and/or prevent the inner capsule from moving (e.g., rotating, etc.) within the exterior body 108. FIGS. 52-53 show a cross sectional view of the exterior body 108 taken from lines 52-52 and 53-53 of FIG. 48. Notch 5302 may engage with notch 520 of the inner capsule 110 to prevent the inner capsule 110 from rotating and to indicate that inner capsule 110 is installed in a correct orientation.

Figure 54:
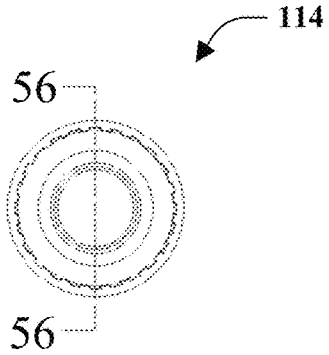
FIG. 54 is a top view of an iron base of a cosmetic container device according to an embodiment.
Figure 55:
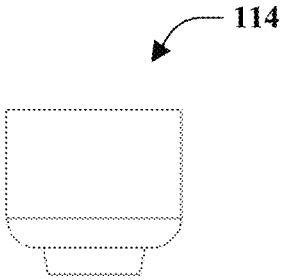
FIG. 55 is a left view of an iron base of a cosmetic container device according to an embodiment.
Figure 56:
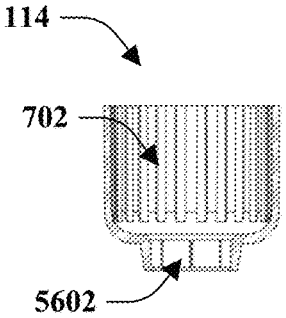
FIG. 56 is a cross sectional view of the iron base taken at line 56-56 of FIG. 54.
Figure 57:
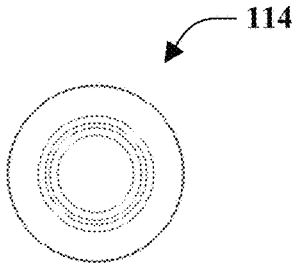
FIG. 57 is a bottom view of an iron base of a cosmetic container device according to an embodiment.

FIGS. 54,55, and 57 show an example embodiment of an iron base. FIG. 56 shows a cross sectional view of the iron base taken from line 56-56 of FIG. 54. In an embodiment, a fixation device may be secured to the iron base at location 5602. The fixation device may be secured by any suitable means such as snap fit, pressure fit, adhesive, screw, and the like. It should be appreciated that the iron base need not be formed of a ferrous material, and the iron base may be formed of any suitable material (e.g., plastic, polymer, composite, etc.) according to sound engineering judgment.

Figure 58:
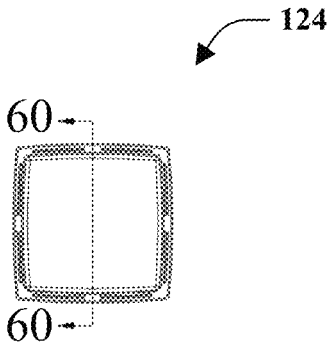
FIG. 58 is a top view of an inner base of a cosmetic container device according to an embodiment.
Figure 59:
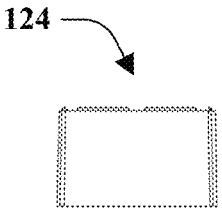
FIG. 59 is a left view of an inner base of a cosmetic container device according to an embodiment.
Figure 60:
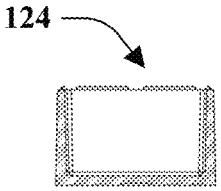
FIG. 60 is a cross sectional view of the inner base taken at line 56-56 of FIG. 54.
Figure 61:
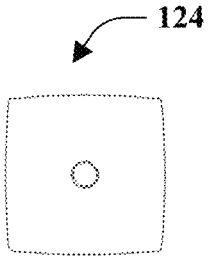
FIG. 61 is a bottom view of an inner base of a cosmetic container device according to an embodiment.
Figure 62:
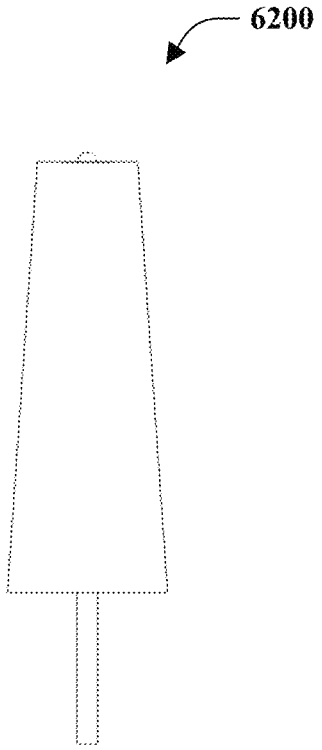
FIG. 62 is a front view of an example embodiment of an application device of a cosmetic container device.
Figure 63:
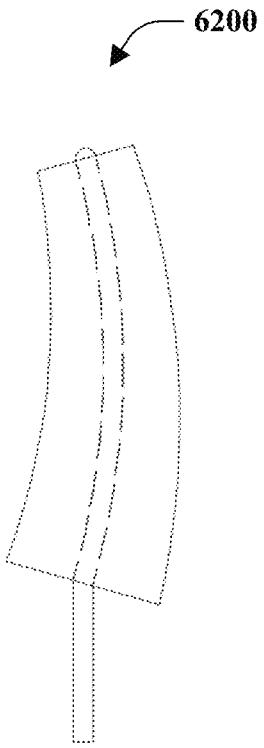
FIG. 63 is a side view of an example embodiment of an application device of a cosmetic container device.
Figure 64:
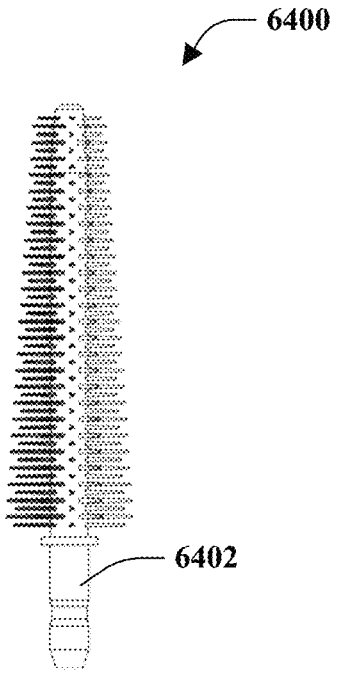
FIG. 64 is a front view of an example embodiment of an application device of a cosmetic container device.
Figure 65:
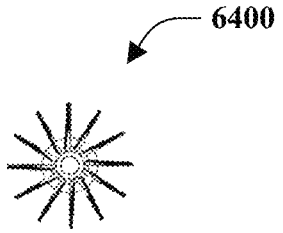
FIG. 65 is a top view of an example embodiment of an application device of a cosmetic container device.
Figure 66:
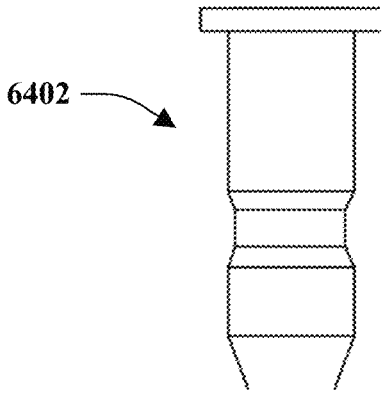
FIG. 66 is a side view of an example attachment member of an application device of a cosmetic container device.

FIGS. 58, 59, and 61 show an example embodiment of an inner base 124. FIG. 60 shows a cross sectional view of the inner base 124 taken from line 60-60 of FIG. 58.

FIGS. 62-66 show examples of various application devices that may be used according to the cosmetic container device as described herein. In an example embodiment, application device 6400 may include an attachment portion 6402 that may engage location 1504 of the inner cap 104. The attachment portion 6402 may have a shape or include features that correspond to the shape or features of the elongated member 304. The attachment portion 6402 may allow for the application device to be fixedly or removably secured to the inner cap 104. The attachment portion 6402 may be secured to the inner cap 104 in any suitable manner (e.g., adhesive, pressure fit, snap fit, etc.).

Figure 67:
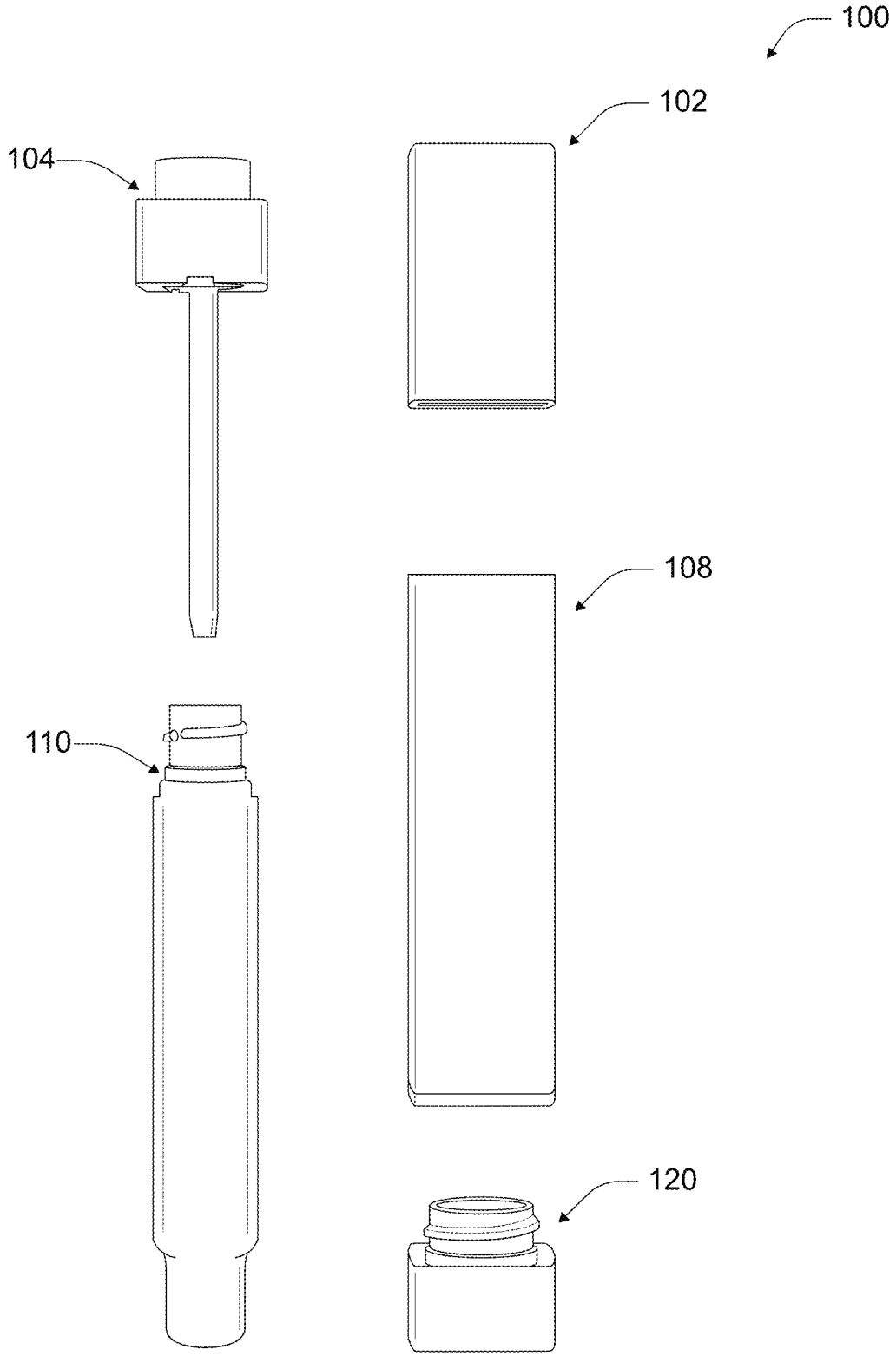
FIG. 67 is an example embodiment of a cosmetic container device.

FIG. 67 shows an example cosmetic container device 100.

Figure 68:
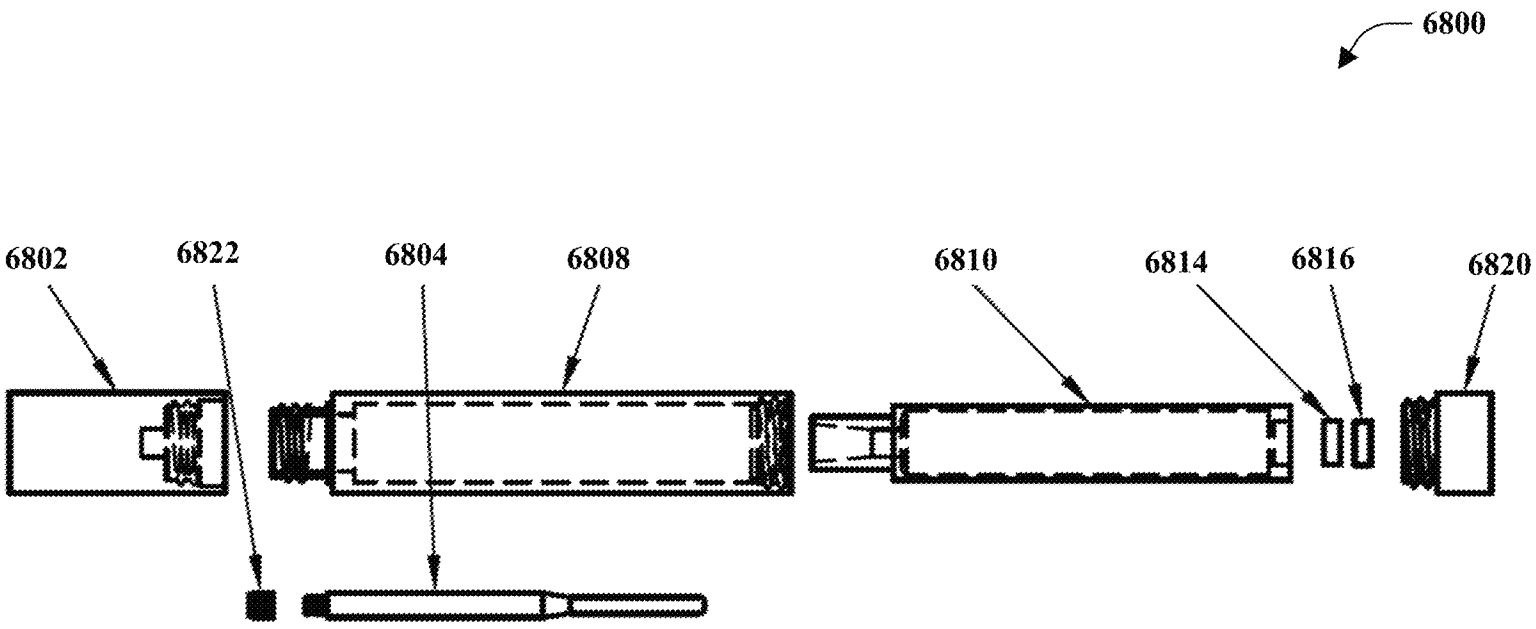
FIG. 68 is an exploded view of an embodiment of a cosmetic container device.

FIG. 68 shows an exploded view of an example cosmetic container device 6800. The cosmetic container device 6800 is substantially the same in some aspects as the above-referenced cosmetic container device 100, and consequently the same reference numerals but indexed by 6800 are used to denote structures corresponding to similar structures in the cosmetic container devices. In addition, the foregoing description of the cosmetic container device 100 is applicable to the cosmetic container device 6800. The cosmetic container device 6800 may include a cap 6802, a body 6808, an inner capsule 6810, fixation devices 6814, 6816, and an end cap 6820. The fixation device 6814 may be received within the inner capsule 6810 and the fixation device 6816 may be received within the end cap 6820. The cosmetic container device may include an elongated member 6804 that may be attached to the cap 6802 using an attachment device 6822. The elongated member 6804 may include an application device, such as a brush or sponge, for applying a cosmetic product from the inner capsule 6810.

Figure 69:
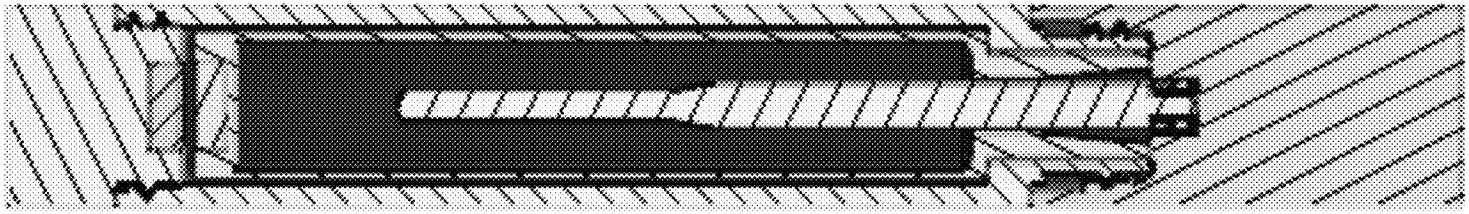
FIG. 69 is a cross sectional view of an embodiment of a cosmetic container device.

FIG. 69 shows another cross sectional view of the example cosmetic container device 6800.

Figure 70:
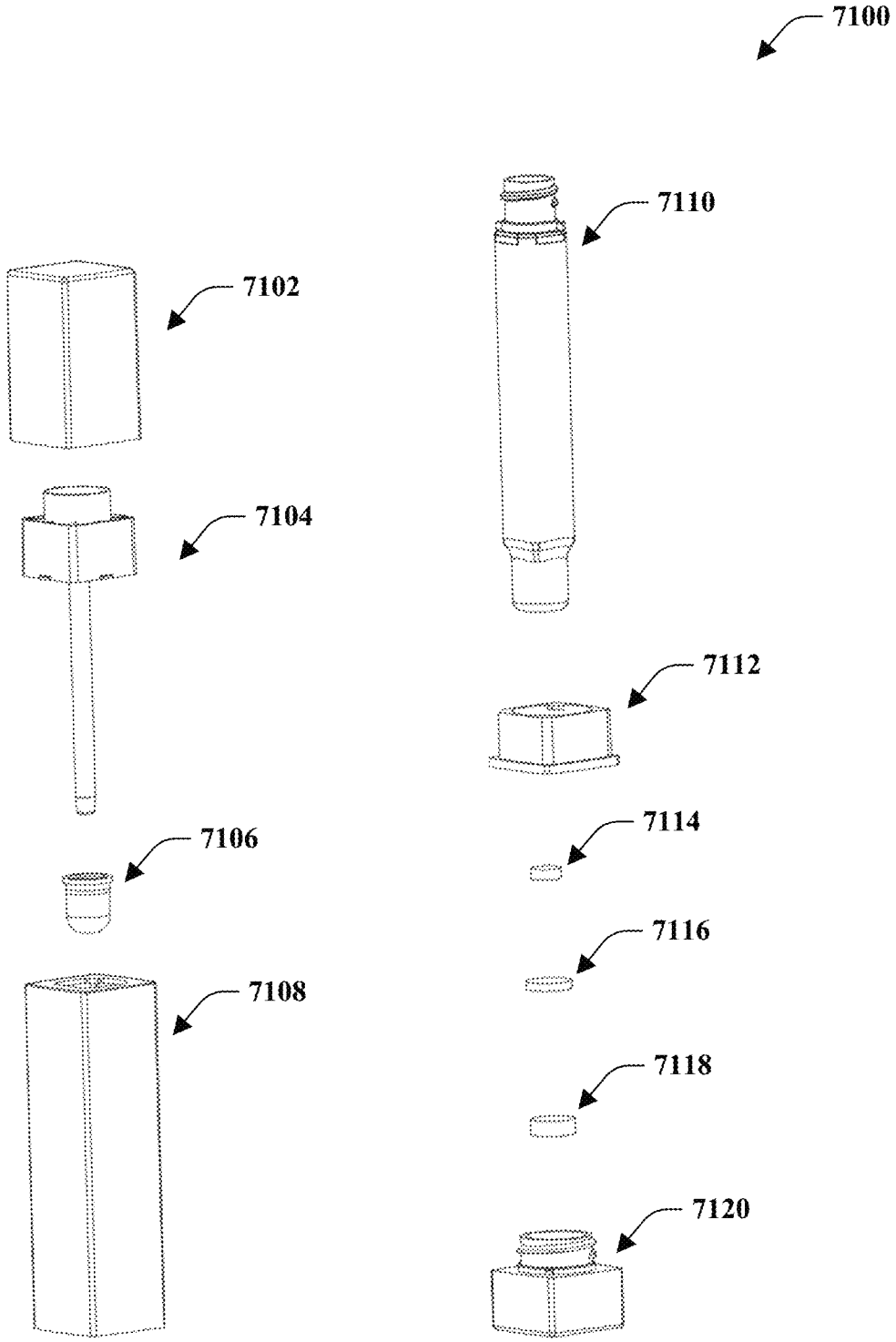
FIG. 70 is an exploded view of an embodiment of a cosmetic container device.

FIG. 70 shows an exploded view of an example cosmetic container device 7100. The cosmetic container device 7100 is substantially the same in some aspects as the above-referenced cosmetic container device 100, and consequently the same reference numerals but indexed by 7000 are used to denote structures corresponding to similar structures in the cosmetic container devices. In addition, the foregoing description of the cosmetic container device 100 is applicable to the cosmetic container device 7100.

The foregoing description has been presented with reference to various embodiments. The embodiments were chosen and described in order to explain the principles of the invention and its practical application. The foregoing description is not intended to be exhaustive or to limit the invention to the precise forms disclosed. Further, while the various embodiments describe particular combinations of features of the invention it should be understood that different combinations of the features will be apparent to persons skilled in the relevant art as within the scope of the invention such that features of one embodiment may be incorporated into another embodiment. Moreover, it will be apparent to persons skilled in the art to which this invention pertains various additions, subtractions, deletions, variations, and other modifications and changes in form, detail, implementation and application can be made therein without departing from the spirit and scope of the invention. It is intended that the broader spirit and scope of the invention be defined by the following claims and their equivalents.

What is claimed is:

1. A cosmetic container device for storing a cosmetic product, comprising:

an exterior body having a first end, a second end, and a throughpassage extending from an opening in the first end to an opening in the second end of the exterior body;

an outer cap removably coupled to the first end of the exterior body;

an inner capsule disposed in the exterior body for storing the cosmetic product, the inner capsule having an opening in a first end and a second closed end, wherein a cavity within the inner capsule is accessible through the opening at the first end; and an end cap removably coupled to the second end of the exterior body, wherein the inner capsule further comprises at least one notch, and the exterior body further comprises at least one groove, the at least one notch of the inner capsule configured to engage with the at least one groove of the exterior body to prevent rotation of the inner capsule relative to the exterior body when the inner capsule is disposed in the exterior body, and wherein the inner capsule is configured to be removed from the exterior body through the opening at the second end of the exterior body when the end cap is detached from the exterior body.

2. The cosmetic container device of claim 1, further comprising an elongated member coupled to the outer cap and extending into the cavity within the inner capsule.

3. The cosmetic container device of claim 2, wherein an application device is attached to the elongated member, the application device configured to remove at least a portion of the cosmetic product from the inner capsule.

4. The cosmetic container device of claim 3, wherein the application device is removably coupled to the elongated member.

5. The cosmetic container device of claim 1, wherein the first end of the inner capsule is removably coupled to the outer cap.

6. The cosmetic container device of claim 1, further comprising a wiper having an opening, the wiper configured to be at least partially installed in the cavity of the inner capsule, wherein the wiper is further configured to create a seal between the inner capsule and an inner cap, the inner cap located within the outer cap.

7. The cosmetic container device of claim 1, wherein the inner capsule is configured to be replaced with another inner capsule storing another cosmetic product.

8. The cosmetic container device of claim 1, wherein the second closed end of the inner capsule is removably coupled to the end cap.

9. The cosmetic container device of claim 8, wherein the inner capsule is removably coupled to the end cap using one or more fixation devices.

10. The cosmetic container device of claim 9, wherein at least a portion of the one or more fixation devices comprises a ferrous material adapted to removably couple the inner capsule to the end cap.

11. The cosmetic container device of claim 1, further comprising at least one magnet for removably coupling the second closed end of the inner capsule to the end cap, the coupling of the second closed end of the inner capsule and the end cap configured such that the inner capsule is removed from the exterior body when the end cap is removed from the exterior body.

12. The cosmetic container device of claim 1, wherein the inner capsule further comprises a securing mechanism to secure the inner capsule within the exterior body, the securing mechanism comprising the at least one notch of the inner capsule and the at least one groove of the exterior body.

13. A cosmetic container device for storing a cosmetic product, comprising:

an exterior body having a first end, a second end, and a throughpassage extending from an opening in the first end to an opening in the second end of the exterior body;

an outer cap removably coupled to the first end of the exterior body;

an inner capsule disposed in the exterior body for storing the cosmetic product, the inner capsule having an opening in a first end and a second closed end, wherein a cavity within the inner capsule is accessible through the opening at the first end; and an end cap removably coupled to the second end of the exterior body, wherein the second closed end of the inner capsule is removably coupled to the end cap such that the second closed end of the inner capsule is coupled to the end cap for removal of the inner capsule from the exterior body, wherein the inner capsule is configured to be removed from the exterior body through the opening at the second end of the exterior body when the end cap is detached from the exterior body.

14. The cosmetic container device of claim 13, further comprising an elongated member coupled to the outer cap and extending into the cavity within the inner capsule.

15. The cosmetic container device of claim 14, wherein an application device is attached to the elongated member, the application device configured to remove at least a portion of the cosmetic product from the inner capsule.

16. The cosmetic container device of claim 15, wherein the application device is removably coupled to the elongated member.

17. The cosmetic container device of claim 13, wherein the first end of the inner capsule is removably coupled to the outer cap.

18. The cosmetic container device of claim 13, further comprising a wiper having an opening, the wiper configured to be at least partially installed in the cavity of the inner capsule, wherein the wiper is further configured to create a seal between the inner capsule and an inner cap, the inner cap located within the outer cap.

19. The cosmetic container device of claim 13, further comprising at least one fixation device for removably coupling the second closed end of the inner capsule to the end cap, the coupling of the second closed end of the inner capsule and the end cap configured such that the inner capsule is removed from the exterior body when the end cap is removed from the exterior body.

20. The cosmetic container device of claim 13, wherein the inner capsule further comprises a securing mechanism to secure the inner capsule within the exterior body, the securing mechanism comprising at least one notch of the inner capsule and at least one groove of the exterior body.

* * * * *